US006294870B1

(12) United States Patent
Kawashima et al.

(10) Patent No.: US 6,294,870 B1
(45) Date of Patent: Sep. 25, 2001

(54) HIGH-PRESSURE DISCHARGE LAMP, HIGH-PRESSURE DISCHARGE LAMP APPARATUS, AND LIGHT SOURCE

(75) Inventors: Hiromichi Kawashima; Makoto Nishizawa, both of Yokosuka (JP)

(73) Assignee: Toshiba Lighting & Technology Corporation (JP)

( * ) Notice: Subject to any disclaimer, the term of this patent is extended or adjusted under 35 U.S.C. 154(b) by 0 days.

(21) Appl. No.: 09/424,539

(22) PCT Filed: Mar. 25, 1999

(86) PCT No.: PCT/JP99/01507

§ 371 Date: Mar. 7, 2000

§ 102(e) Date: Mar. 7, 2000

(87) PCT Pub. No.: WO99/50887

PCT Pub. Date: Oct. 7, 1999

(30) Foreign Application Priority Data

Mar. 25, 1998 (JP) ..... 10-078027
Jun. 11, 1998 (JP) ..... 10-163403
Mar. 11, 1999 (JP) ..... 10-065701

(51) Int. Cl.[7] ..... H01J 17/18
(52) U.S. Cl. ..... 313/623; 313/624; 313/625
(58) Field of Search ..... 313/331, 332, 313/624, 251, 625, 252, 626, 284, 631, 632, 634, 637, 638, 639, 640, 641

(56) References Cited

U.S. PATENT DOCUMENTS 4,570,104 * 2/1986 Janssen et al. ..... 313/50
4,825,127 * 4/1989 Krasko et al. ..... 313/638
5,128,588 * 7/1992 Kameya et al. ..... 313/623
5,336,968 * 8/1994 Strok et al. ..... 313/571
5,698,946 * 12/1997 Merker ..... 313/623
5,723,944 * 3/1998 Higashi et al. ..... 313/570
5,905,338 * 5/1999 Verspaget et al. ..... 313/623

* cited by examiner

*Primary Examiner*—Nimeshkumar D. Patel
*Assistant Examiner*—Ken A Berck
(74) *Attorney, Agent, or Firm*—Morrison Law Firm

(57) ABSTRACT

A cathode-side first sealed portion (14) and an anode-side first sealed portion (15) are respectively provided at the two opposing ends of a discharge space (21) of a discharge casing (11). A middle chamber (16) filled with a rare gas is provided adjacent to the anode-side first sealed portion (15). A second sealed portion (18) is provided adjacent to the middle chamber (16). Each sealed portion (14),(15),(18) is airtightly sealed by the pinch sealing method. A cathode (22) is welded to a metal foil conductor (24) disposed in the cathode-side first sealed portion (14). An anode (23) is welded to a metal foil conductor (32) disposed in the anode-side first sealed portion (15). The metal foil conductor (32) in the anode-side first sealed portion (15) and a metal foil conductor (35) in the second sealed portion (18) are connected to each other by means of a lead wire (33) passing through the middle chamber (16). A lead wire (36) that is drawn out of the lamp is welded to the metal foil conductor (35) in the second sealed portion (18). A sufficient distance from the discharge space (21), from which the heat is conducted, to the second sealed portion (18) exposed to the outside air can easily be ensured. Therefore, the invention is capable of ensuring the functioning of the high pressure discharge lamp (1) to the end of its life by protecting the welded portions of the lead wire (36) from deterioration, which may otherwise occur due to the exposure to the outside air at high temperature.

19 Claims, 14 Drawing Sheets

HIGH-PRESSURE DISCHARGE LAMP, HIGH-PRESSURE DISCHARGE LAMP APPARATUS, AND LIGHT SOURCE

TECHNICAL FIELD

The present invention relates to a high-pressure discharge lamp, a high-pressure discharge lamp device and a light source device, each one of which may be used in, for example, a liquid crystal projector.

BACKGROUND OF THE INVENTION

Nowadays, projection-type image display devices are rapidly becoming commonplace. Such a display device is often equipped with a high pressure discharge lamps as its light source. Among various high pressure discharge lamps, short-arc type high pressure discharge lamps that function virtually as point sources of light and are easy to arrange and control, are widely used as the light sources of liquid crystal projectors, which are becoming particularly popular these days. Typical examples of said short-arc type high pressure discharge lamps include xenon lamps and metal halide lamps.

A liquid crystal projector is an apparatus adapted to project images onto a screen by using a liquid crystal display panel and is capable of clearly projecting not only static images but also moving pictures. As liquid crystal projectors are capable of projecting various images based on signals representing the images regardless of whether the input signals are analog or digital, they are used as a tool for making presentations, a screen in a make-shift theater, or as the screen of a large-screen television, and their demands are expected to keep increasing in the future.

Compared with such inexpensive image display devices as CRT displays, liquid crystal projectors are very expensive. Therefore, efforts are being exerted to provide a less expensive liquid crystal projector by making it compact or otherwise reducing its production costs. Furthermore, as there is still room for further improvement in brightness, progress is being made to employ a special optical system.

As it is mentioned above, a high pressure discharge lamp is popularly used as a light source device for a liquid crystal projector, and what are now required of a high pressure discharge lamp are a reduced distance between the electrodes, a higher efficiency and a longer life span. In addition to these demands, ensured reliability and reduction of production costs, which is the present objective of the liquid crystal projector, are required of high pressure discharge lamps.

In most cases, a high pressure discharge lamp used in such an image display apparatus as mentioned above is installed in the apparatus in such a manner that it will be lit in the horizontal position. When a lamp is lit in the horizontal position, a convection current generated in the arc tube makes the temperature of the upper part of the inside of the arc tube higher than the other part, thereby making the temperature distribution in the entire arc tube nonuniform. In order to solve the problem of nonuniformity of temperature distribution, an air cooling device, such as a fan, is installed.

One of the important processes of producing a high pressure discharge lamp is the sealing process to form the inside of the arc tube into an airtight space. The sealing process is conducted by the pinch sealing method, which enables the quick and efficient processing. A portion sealed by the pinch sealing method can be maintained in a sufficiently airtight state having the ability to withstand the high internal pressure and ensures reliable functioning of the lamp in desired performance characteristics for a long period of time.

The arc tube has to be provided with two sealed portions: one each at the cathode side and the anode side. A metal foil conductor which is made of molybdenum and connected to the cathode is attached to one of the sealed portions, while another molybdenum metal foil conductor, which is connected to the anode, is attached to the other sealed portion. A lead wire made of molybdenum extends from each sealed portion to the outside of arc tube. Inside each sealed portion, the metal foil conductor and the lead wire are connected by welding. As the outside atmosphere enters the portion where they are welded, the welded portion is in a condition similar to that if it were exposed to fire. As a result, when it is in a high temperature environment for a long time, it is prone to oxidation and possible breakage. There is a demand for an effective means to solve this problem by maintaining the welded portions at a lower temperature.

This may be achieved by somehow reducing the heat conducted from the heat source or cooling the welded portion to limit increases of temperature. However, a cooling method is almost never employed, because noises produced by an air blower, which may be an air cooling fan or the like, make it difficult to attain the objective of reducing noises. Therefore, lamps produced these days usually employ a method which calls for increasing the length of either one of or each sealed portion in order to reduce the heat conducted from the source of heat generation. FIG. 7 is a characteristic graph showing the relationship between distances from various points to the surface of the discharge space of the arc tube, which is the source of heat generation, and temperatures at said points. When the distance from the surface of the discharge space of the arc tube exceeds 30 mm, the temperature is in the permissible range to ensure that the sealed portion achieves the expected life expectancy.

However, in case the lamp is a small high pressure discharge lamp described above with the length of the portion to be sealed exceeding 30 mm, it is difficult to seal the target portion by the pinch sealing method. In other words, in case of a small high pressure discharge lamp, it is impossible to provide a sufficiently long distance from the center of the arc, which serves as the source of heat generation.

Accordingly, the first object of the present invention is to ensure that the sealed portion achieves the expected life expectancy and to provide a high pressure discharge lamp, a high pressure discharge lamp device and a light source device using said high pressure discharge lamp, wherein the lamp has sealed portions formed by the pinch sealing method, and wherein a sealed portion is maintained at a desired distance from the heat source.

As described above, an arc tube to be lit in the horizontal position may be provided with an air cooling device, such as an air blower, in order to make the temperature distribution uniform throughout the inside of the arc tube. However, installing an air cooling device not only presents the problem of noises but also presents another problem in that it may become impossible to obtain necessary luminescence characteristics if the arc tube is cooled excessively. In other words, control of the air cooling device is difficult. Although this problem may be overcome by lighting the arc tube in the vertical position, vertical lighting causes substantial increase of the temperature of the upper sealed portion and, therefore, tends to enhance oxidation of the metal foil sealed therein and makes the metal foil even easier to break.

Accordingly, the second object of the present invention is to ensure that the sealed portion achieves the expected life expectancy when the lamp is used in the vertical position and to provide a high pressure discharge lamp, a high pressure discharge lamp device and a light source device using said high pressure discharge lamp, wherein the possibility of breakage of a metal foil is reduced even if the lamp is used in the vertical position.

As it is mentioned above, floodlight illumination and image display devices are rapidly becoming commonplace over recent years, and high pressure discharge lamps are used as their light sources in most cases. Among various high pressure discharge lamps, short-arc type high pressure discharge lamps that function virtually as point sources of light and are easy to arrange and control, such as metal halide discharge lamps, are widely used as the light sources of liquid crystal projectors, which are becoming particularly popular these days in addition, using a metal halide discharge lamp as the light source of a vehicle headlight is becoming more commonplace, while small, short-arc type high pressure discharge lamps are widely used as spot lights for store illumination and other purposes.

Next, examples of conventional high-pressure discharge lamps for liquid crystal projectors are explained hereunder, referring to drawings.

FIG. 19 is a front view of a first example of conventional high-pressure discharge lamps for liquid crystal projectors.

Referring to FIG. 19, numeral 101 denotes a discharge casing, numeral 102 an anode, 103 a cathode, 104, 104 sealed molybdenum foils, 105 an external lead wire, and 106 a base.

The discharge casing 101 consists of a discharge space portion 101*a* and a pair of sealed portions 101*b*, 101*c* respectively extending from the two opposing ends of the discharge space portion 101*a*. A sealed molybdenum foil 104 is airtightly buried in each sealed portion 101*b*, 101*c*. An appropriate quantity of discharge medium comprised of mercury, a rare gas and a halide of luminous metal is sealed in the discharge space portion 101*a*.

The anode 102 has an electrode shaft 102*a*, which is inserted in the sealed portion 101*b* and welded to an end of the sealed molybdenum foil 104. The external lead wire 105 is welded to the other end of the sealed molybdenum foil 104.

In the same manner as the anode, the electrode shaft 103*a* of the cathode 103 is inserted in the other sealed portion, i.e. the sealed portion 101*c*, and welded to an end of the sealed molybdenum foil 104 buried therein. Another external lead wire (not shown in the drawing) is welded to the other end of the sealed molybdenum foil 104 and connected to a cathode terminal 106*a* of the base 106.

The base 106 has a cylindrical body 106*b*, which is made of stainless steel and bonded to the cathode-side sealed portion 101*c*.

Next, a liquid crystal projector is explained.

A liquid crystal projector is a device adapted to project an image formed on a liquid crystal screen, regardless of whether the image is static or moving picture. As it is capable of projecting various images based on signals which may be video signals or computer-generated images input into the projector, the projector is used in various fields; for example, it may be used as a tool for making presentations, a screen in a make-shift theater, or as the screen of a large-screen television.

The rear-projection TV has become more commonplace among large-screen televisions over recent years. When a liquid crystal projector is used as a television, performance characteristics that are equivalent to those of a television of the cathode-ray tube type are required of the projector. For example, the projector may be required to have a life span of more than 10,000 hours and be ensured to operate to project sufficiently visible images immediately after being switched on, and be capable of immediate restart even if it is switched off by mistake.

Among various factors required of the liquid crystal projector, superior brightness and lower costs are given the priority. Therefore, metal halide-type ultra high pressure discharge lamps are most widely used nowadays. In order to obtain more intense luminance, a ultra high pressure discharge lamp is usually designed such that the internal pressure in the discharge casing amounts to more than 30 atmosphere (30 atm) during the time that the lamp is lit. Although safety is sought for by increasing the thickness of the wall of the discharge casing, which is made of quartz glass, or devising a safer shape, there is still the possibility for the discharge casing to burst before the end of its life span. Breakage of the discharge casing may result in damage to other optical parts.

Therefore, a structure that calls for integrating a reflecting mirror with the high pressure discharge lamp is employed in order to prevent or minimize scattering of the glass in case of breakage of the discharge lamp, or in order to facilitate maintenance of the lamp, such as adjusting the position of the optical parts. Other examples of widely employed structures include one that calls for covering the aperture of the reflecting mirror with a glass protector plate.

Next, a metal halide discharge lamp used in a headlight of a vehicle is explained hereunder.

A metal halide high pressure discharge lamp for a vehicle headlight is primarily required to be capable of performing instantaneous start-up and restart more quickly than does a metal halide high pressure discharge lamp for a liquid crystal projector. For this reason, a metal halide high pressure discharge lamp for a vehicle headlight is typically filled with xenon gas at approximately 5 atm at normal temperature as well as mercury that will serve as a buffer medium during the time when the lamp is in the lit state, with the pressure of mercury vapor then amounting to more than 20 atm.

Other than metal halide discharge lamps described above, mercury lamps are included in the examples of a high pressure discharge lamp whose discharge medium includes mercury serving as a luminous body or a buffer medium. Whereas metal halide discharge lamps use mercury as a buffer medium, mercury lamps use mercury as a luminous medium.

In case of any one of the high pressure discharge lamps mentioned above, the mercury contained in the discharge casing condenses on the surface of the electrodes when the lamp is turned off. This is because the electrodes cool down more quickly than does the inner surface of the discharge casing.

In case of a high pressure discharge lamp of a DC-powered type, whose cathode is smaller than the anode and therefore cools faster, the mercury tends to become attached to the cathode.

Mercury thus adhering to the surface of an electrode reduces electron emission from the cathode and consequently impairs such performance of the lamp as start-up and restart.

In cases where a high pressure discharge lamp is enclosed by a reflecting mirror and a glass protector plate or disposed in an outer tube, the high pressure discharge lamp does not easily cool down after it is switched off. Restarting such a high pressure discharge lamp when the vapor pressure of the discharge is still high requires start-up voltage having substantial pulse energy to be applied between the electrodes.

However, increasing the pulse energy of the start-up voltage not only makes insulation of the lighting components difficult and expensive but also increases radiated noises. In case of a device incorporating a microcomputer, increase in noises may cause malfunction of the microcomputer, A structure aimed at improving start-up performance is disclosed in Japanese Provisional Publication No. 61957/1990.

FIG. 20 is a front view of a second example of conventional high-pressure discharge lamps, which has the same structure as the one disclosed Japanese Provisional Publication No. 61957/1990. The elements corresponding to those in FIG. 19 are identified with the same reference numerals, explanation of which is omitted herein.

The second example of conventional high pressure discharge lamps shown in FIG. 20 is characterized in that a starting conductor 107 having the same electrical potential as that of the cathode 103 extends along the cathode-side sealed portion 101*c* and, after being wound once around the borderline between the discharge space portion 101*a* and the sealed portion 101*c*, further extends along the discharge space portion 101*a* and that the end portion of the starting conductor 107 is then wound once around the borderline between the discharge space portion 101*a* and the anode-side sealed portion 101*b*, which is located opposite the sealed portion 101*c*.

FIG. 21 is a front view of a third example of conventional high-pressure discharge lamps. The elements corresponding to those in FIG. 19 are identified with the same reference numerals, explanation of which is omitted herein.

The third example of conventional high pressure discharge lamps shown in FIG. 21 has a structure such that a starting conductor 108 having the same electrical potential as that of the cathode. 103 extends along the cathode-side sealed portion 101*c* and that the end portion of the starting conductor 107 is wound once around the borderline between the discharge space portion 101*a* and the sealed portion 101*c*.

Compared with the first example of conventional high pressure discharge lamps, both the second and third examples described above are capable of reducing the start-up voltage. However, neither example is capable of reducing the start-up voltage to a desired level. Furthermore, there is no significant difference in effectiveness between a high pressure discharge lamp according to the second example and a high pressure discharge lamp according to the third example.

In other words, according to any one of the examples of conventional art described above, restarting the lamp within several dozens seconds of turning off the lamp requires application of a pulse voltage having substantial energy. Thereafter, the pulse energy gradually decreases. In addition, from 3 to 5 minutes after turning off the lamp, there is a period when great pulse energy is needed again.

Accordingly, the third object of the present invention is to provide a high pressure discharge lamp having superior performance characteristics in start-up and restart-up while having a simple structure, and also provide a high pressure discharge lamp device and a light source device using said high pressure discharge lamp.

DISCLOSURE OF THE INVENTION

A high pressure discharge lamp according to the present invention includes a discharge casing having an airtight discharge space a pair of electrodes disposed in the discharge space in such a manner that one end of an electrode faces an end of the other electrode; a pair of first sealed portions respectively sealing the other ends of the electrodes in an airtight state; a lead portion provided at either one of the ends or each end of the discharge casing in such a manner that one end of each lead portion is connected to said other end of the electrode disposed at the same side of the discharge casing and airtightly sealed in the corresponding first sealed portion; a second sealed portion for airtightly sealing the other end of each lead portion; and a middle chamber which is provided between each second sealed portion and the first sealed portion located closer to said second sealed portion in an airtight state so that the corresponding lead portion passes through the middle chamber.

Definition and technical concepts of the terms mentioned herein are now explained hereunder.

A 'high pressure discharge lamp' refers to a high pressure mercury lamp, such a high pressure gas discharge lamp as a xenon lamp, and a metal halide lamp. Accordingly, the discharge medium has to be composed so as to suit such a high pressure discharge lamp. Such an additive as a metal halide or the like may also be sealed in a high pressure mercury lamp.

A 'discharge casing' refers to a container that constitutes an arc tube, and there are no limitations as to the shape, the dimensions or the material.

With regard to the manner of discharge, it does not matter whether it is a DC discharge or an AC discharge. The electrodes are so arranged as to cope with the manner of discharge.

According to the present invention, the distance from the discharge space serving as the heat source to the outer end of the second sealed portion or each sealed, at which the lead portion is exposed to the outside air, can be maintained at a desired length so that the lead portion is protected from deterioration that may otherwise be caused by the heat.

When a lead portion according to the invention is used in a small high pressure discharge lamp that includes sealed portions sealed by the pinch sealing method, and said lead portion has lead wires and conductors that are welded to one another at one of the first sealed portions and the second sealed portion, the distance from the heat source to the second sealed portion is maintained at a desired length so that the heat conducted to the welded portions of the lead wires is limited. Therefore, the invention can reliably prevent breakage of the welded portions.

The middle chamber may be maintained in a vacuum or filled with a rare gas.

Examples of the gases that can be sealed in the middle chamber include argon, krypton or xenon. Nitrogen gas may also be used. In cases where the middle chamber does not contain a rare gas, it is necessary to discharge the air from the hollow inside of the middle chamber during the production process of the middle chamber until the inside becomes completely vacuous.

By providing a structure which calls for providing a middle chamber only at one of the first sealed portions and using the lamp in a position such that the middle chamber is located at the upper part of the lamp, it is possible to increase the distance from the heat source to the second sealing portion, which is located in the upper part of the lamp and therefore prone to being heated during the time that the high pressure discharge lamp is lit. Such a structure is thus capable of limiting the heat conducted to the portion where the lead portion is exposed to the outside air, particularly the portion where the lead wires are welded in the second sealing portion, and prevents the lead wires from breaking at the welded portions.

Each first sealed portion may be provided with a middle chamber.

In the configuration where one of the two electrodes serves as a cathode while the other electrode serves as an anode, the lamp may be lit in a position such that the anode is located above the cathode. An anode usually has a great thermal capacity to have a sufficient resistance to a thermal shock caused by electron collision resulting from a discharge, while a cathode is designed to have a small thermal capacity in order to enhance discharge of thermo-electrons. Generally speaking, materials which are widely used as discharge media, such as mercury or various metal halides, tend to condense on the portion of the arc tube with the lowest temperature during the initial stage of lighting the lamp. However, in cases where the lamp is lit in the vertical position or other similar position where one of the electrodes is disposed at a location higher than the other electrode, the metal that constitute the discharge medium condenses around the lower electrode, the temperature of which is prone to being relatively lower. According to the present invention, the cathode, which usually has a small thermal capacity, is located lower than the anode, which has a greater thermal capacity. When the lamp is turned on, the temperature of the cathode, which is located in the lower part of the lamp, rapidly increases due to its small thermal capacity. The invention is thus capable of improving rising characteristics of the luminous flux of the high pressure discharge lamp.

The discharge casing may be provided with a convex portion constituting a discharge space, with the dimensions of various components of the lamp set such that:

$$0.29 \leqq \{(a-n)/L\} \leqq 2.7$$

$$5L \leqq D$$

wherein the distance between the upper end and the lower end of the convex portion is represented by 2*a*; the distance from the lower outer end of the convex portion to the midpoint of the distance between the two electrodes is represented by n; the distance between the anode and the cathode 22 is represented by L; and the diameter of the discharge space formed in the convex portion is represented by D. Such a structure is capable of reducing the degree of the expansion and the possibility of a burst of the convex portion during the time that the lamp is lit in the vertical position, thereby ensuring reliable functioning of the lamp in intended performance characteristics to the end of its life. The above criteria are based on the following findings: firstly, should the lamp have such dimensions as $\{(a-n)/L\}<0.29$, the distance L between the electrodes is too long to fulfill the condition of $5L \leqq D$; if the inner diameter of the discharge space is set within the range of $5L \leqq D$ in this condition, the inner diameter D, too, becomes so great as to make it difficult to produce a small lamp. On the other hand, setting the dimension D in the range of $5L>D$ without fulfilling the condition of $5L \leqq D$ will result in expansion of the convex portion 11*a* due to the heat of arc discharge, because the inner diameter D of the discharge space is relatively short with respect to the long arc, Should the lamp have such dimensions as $\{(a-n)/L\}>0.27$, the distance L between the electrodes is too short to obtain desired light generation characteristics while fulfilling the condition of $5L \leqq D$. On the other hand, setting the dimension D within the range of $5L>D$ without fulfilling the condition of $5L \leqq D$ will result in expansion of the convex portion due to the heat of arc discharge, because the arc is too close to the wall of the convex portion.

Merely fulfilling the condition of $0.29 \leqq \{(a-n)/L\} \leqq 2.7$ is not sufficient; should the condition of $5L \leqq D$ be not fulfilled, there is the possibility of expansion, and, consequently, burst of the convex portion.

According to another feature of the invention, the lead portion extending through the middle chamber is providing with a filament that is so designed as to fuse at the end of a predetermined life span. Such a structure efficiently prevents a sudden burst of the airtight container, which may otherwise occur at the end of the life of the high pressure discharge lamp and cause an unexpected malfunction of the apparatus equipped with the high pressure discharge lamp.

According to yet another feature of the invention, the filament comprises a filament material extending in a straight line or a coiled filament so that the straight filament material or the coiled filament material functions as the filament that is adapted to fuse at the end of a predetermined life span. As the invention thus permits the filament to be formed of a conventionally available material, the invention provides an inexpensive discharge lamp.

According to yet another feature of the invention, a high pressure discharge lamp includes a translucent discharge casing; a pair of electrodes sealed in the discharge casing; a discharge medium which is sealed in the discharge casing and contains at least mercury and a rare gas; and a starting conductor having the same electrical potential as that of one of the electrodes, i.e. the electrode onto which the mercury will condense after the lamp is turned off, said starting conductor extending from the vicinity of said electrode and further extending loosely along the discharge casing, with the leading end of the starting conductor positioned somewhere between the location where it faces the side of said electrode and the location where it faces the side of the other electrode.

With regard to the present feature and other features mentioned hereunder of the Invention, definition and technical concepts of the terms are as follows unless specifically described otherwise.

Translucent Discharge Casing

The translucent discharge casing may be made of any material provided that the material is airtight and has sufficient heat resistance to withstand the normal operating temperature of the high pressure discharge lamp and is also capable of releasing the visible light in a desired wavelength range to the outside of the casing, said visible light having been generated by the electric discharge. Examples of usable materials include quartz glass, translucent alumina, ceramics such as YAG, and single crystals of these materials.

If it is necessary, the inner surface of the translucent discharge casing may be coated with a transparent film having the abilities to withstand halides and metals, or it may be treated in some other way to have such abilities.

The Pair of Electrodes

It does not matter whether a high pressure discharge lamp according to the invention is designed to be lit by DC power or AC power.

Therefore, in case of a lamp designed to operate by AC power, the two electrodes have the same structure. In case of a lamp designed to operate by DC power, however, the anode is so formed as to have a mass and a surface area both greater than those of the cathode, because, as a general rule, the temperature of the anode increases more sharply than does the cathode.

Furthermore, it does not matter whether a high pressure discharge lamp according to the invention is of a short-arc type or a long-arc type.

A short-arc type lamp refers to what is generally called a lamp of an electrode-stabilized type, which calls for stabilizing the arc discharge by means of electrodes, that is by reducing the distance between the electrodes in the translucent discharge casing. As a high pressure discharge lamp of such a type thus emits light in a manner similar to a point light source, the rays of light can efficiently be converged by an optical system, such as a reflecting mirror or a lens.

In case of a high pressure discharge lamp to be incorporated in a projector, such as a liquid crystal projector, or a vehicle headlight, a small, metal halide high pressure discharge lamp of a short-arc type is used. In actual use, the distance between the electrodes of such a lamp should suitably be not more than 6 mm. Should the distance between the electrodes exceed 6 mm, the lamp does not function as a point source of light and therefore impairs the focal characteristics of the optical system. This brings about various undesirable results: for example, if the lamp is used in a liquid crystal projector, it reduces the screen illuminance of the projector.

Therefore, the distance between the electrodes of a short-arc high pressure discharge lamp according to the invention is not more than 6 mm, preferably less than 4 mm. In case of a lamp used-in a projector, such as a liquid crystal projector, or a vehicle headlight, the distance between the electrodes should most appropriately be in the range of 1 to 3 mm. The distance between the electrodes is determined by measuring the distance between the tips, i.e. the inner ends, of the respective electrodes.

A long-arc type lamp refers to what is generally called a lamp of tube wall-stabilized type, which calls for using the inner surface of the translucent discharge casing in order to stabilize the arc formed between the electrodes in the translucent discharge casing.

High pressure discharge lamps of a long-arc type are widely used for general illumination and other various purposes.

A Discharge Medium

A discharge medium used in the present invention contains at least mercury. As described above, after the lamp is turned off, mercury tends to condense on the surface of the electrodes and impairs the starting ability and the restarting ability of the lamp. The present invention aims at solving this problem.

When actually used, the discharged medium sealed in the lamp contains a rare gas in addition to mercury. Examples of rare gases that can be used include xenon, argon, krypton and the like.

In case of a metal halide discharge lamp, a halide of a luminous metal is added to said discharge medium.

A Starting Conductor

As is true in the second and third examples of the conventional art, a starting conductor according to the invention has the same electrical potential as that of one of the electrodes and extends from the vicinity of said electrode and further extends loosely along the translucent discharge casing. However, the location of the leading end of the starting conductor is different from that of either example of conventional art. In other words, according to the present invention, the leading end of the starting conductor characteristically faces the discharge space and is located between the point facing the side of said electrode and the point facing the side of the other electrode.

Furthermore, as the starting conductor has the function of generating an initial glow discharge, only a small amount of current passes through the starting conductor. Therefore, a thin metal wire can be used to form a starting conductor. Using a thin metal wire prevents reduction in the amount of effective light and nonuniformity of light distribution, because it makes visible light generated by a discharge difficult to be absorbed.

The Function of the Invention

According to the configuration described above, when a start-up voltage is applied between the two electrodes at a start-up or restart-up of the high pressure discharge lamp, a glow discharge is generated at first between the leading end of the starting conductor and the electrode located opposite the leading end of the starting conductor. As the generation of glow discharge takes place close to one of the two electrodes, the glow discharge easily shifts to an arc discharge between the electrodes. Thus, the high pressure discharge lamp becomes illuminated.

Therefore, as the starting conductor effectively contributes to start-up of the lamp, the present invention substantially improves the performance characteristics in start-up and restart-up of the lamp.

According to the second example of the conventional art, the starting conductor extends until that the leading end of the starting conductor lies adjacent to the shaft of the opposite electrode,:and the shortest distance between the starting conductor and the electrode is the distance between the leading end of the starting conductor and the electrode shaft. Therefore, at first, a glow discharge occurs between the leading end of the starting conductor and the electrode shaft. However, as the glow discharge range is removed from the gap between the two electrodes, it is not easy for the glow discharge to shift to an arc discharge between the electrodes. In other words, the function of the structure of the second example is surprisingly insufficient to enhance starting up.

According to the third example of the conventional art, a glow discharge is difficult to occur, because the leading end of the starting conductor lies adjacent to the perimeter of the electrode axis. In other words, the conductor of the third example does not have much function as a starting conductor.

As described above, as a result of the structure which calls for providing a starting conductor having the same electrical potential as that of one of the electrodes, i.e. the electrode onto which the mercury will condense after the lamp is turned off, and disposing said starting conductor in such a manner as to extend along the discharge casing so that the leading end of the starting conductor is positioned somewhere between the location where it faces the side of said electrode having the same electrical potential as the starting conductor and the location where it faces the side of the other electrode, i.e. the electrode located opposite said electrode, the present invention facilitates the shifting from a glow discharge generated between the starting conductor and the aforementioned opposite electrode to an arc discharge between the two electrodes. The invention thus provides a high pressure discharge lamp with improved performance characteristics in start-up and restart-up.

Positioning the starting conductor such that its end is aligned with a point between the two electrodes makes it easier for a glow discharge generated between the starting conductor and the opposite electrode to shift to an arc discharge between the two electrodes. The leading end of the starting conductor may be positioned anywhere between the electrodes.

As a result of the above structure that calls for positioning the end of the conductor at such a location as to be aligned with some point between the two electrodes, the invention is capable of providing a high pressure discharge lamp having the optimum performance characteristics in start-up and restart-up.

A structure which includes two electrodes that consist of a cathode and an anode and a starting conductor having the same electrical potential as that of the cathode defines a high pressure discharge lamp of a DC-powered type. As described above, mercury adhering to the surface of the cathode reduces electron emission from the cathode. The structure according to the invention, however, improves the performance characteristics of the lamp in start-up and restart-up by first generating a glow discharge between the starting conductor and the anode and then shifting the glow discharge to a DC arc discharge between the cathode and the anode.

Furthermore, a structure such that the electrodes consist of a cathode and an anode and a starting conductor having the same electrical potential as that of the cathode provides a high pressure discharge lamp of a DC-powered type.

A high pressure discharge lamp device according to the invention includes a high pressure discharge lamp of the invention, and a reflecting mirror so positioned as to be concentric with the optical axis of the high pressure discharge lamp. The invention thus provides a high pressure discharge lamp device having the same effects as those of the structures described above.

A high pressure discharge lamp device according to another feature of the invention includes a high pressure discharge lamp of the invention, and a reflecting mirror which has a concave shape and is integrally secured with the high pressure discharge lamp in such a manner as to cover at least the light emitting portion of the high pressure discharge lamp. The invention thus provides a high pressure discharge lamp device having the same effects as those of the structures described above. The high pressure discharge lamp and the concave reflecting mirror may most appropriately be fixed to each other in a given positional relationship by a fixing means, such as base cement or other adhesive. If it is desired, however, they may be secured together in such a manner that they can be separated from each other at need. A sealed portion or the sealed portions of the discharge casing may be used for fixing the high pressure discharge lamp to the concave reflecting mirror. There is no need of enclosing the whole high pressure discharge lamp in the concave reflecting mirror; for example, the sealed portion of one of the electrodes may project from the concave reflecting mirror to the outside. A mirror having a body made of glass or a metal may be used as the concave reflecting mirror. In any one of the structures described above, thermal rays projected to the irradiated surface can be reduced by employing a mirror whose reflecting surface is capable of reflecting visible light and transmitting thermal rays. One of the typical examples of such mirrors is a dichroic reflection mirror. Although a high pressure discharge lamp device having the structure described above is suitable as the light source of a projecting apparatus, such as a liquid crystal projector, it can also be used as the light source of a spot-light or a down light.

A high pressure discharge lamp device according to another feature of the invention includes a high pressure discharge lamp of the invention, a reflecting mirror which has a concave shape and is integrally secured with the high pressure discharge lamp in such a manner as to cover at least the light emitting portion of the high pressure discharge lamp, and a translucent front cover that closes the open end of the reflecting mirror. The invention thus provides a high pressure discharge lamp device having the same effects as those of the structures described above. It does not matter whether the gap between the translucent front cover and the concave reflecting mirror is maintained airtight or not. The translucent front cover may be fixed to the concave reflecting mirror by means of a silicone adhesive or mechanically fixed by using a metal frame. Furthermore, thermal rays projected to the irradiated surface can be reduced by forming a film adapted to reflect visible light and transmitting thermal rays on the inner surface or the outer surface of the translucent front cover. If it is necessary, the translucent front cover may also function as a color filter to effectively pass rays of light in a specified wavelength range of the visible light. The present invention, however, does not require any particular optical treatment on the translucent cover. According to the invention, the open end of the reflecting mirror is closed with the translucent front cover. Therefore, in case the high pressure discharge lamp bursts, the translucent front cover prevents the broken pieces from scattering. On the other hand, closing the reflecting mirror with the translucent front cover makes the high pressure discharge lamp harder to cool down after it is turned off. Generally speaking, this makes restarting the lamp difficult. Because of the structures defined in claims 1 to 3, however, the present invention is capable of reliable restarting with a restart voltage lower than that required by a conventional lamp.

A light source device according to the invention includes a high pressure discharge lamp of the invention, and a main body to which the high pressure discharge lamp is attached. The invention thus provides a light source device having the same effects as those of the structures described above.

The term 'light source device' mentioned above refers to any device which makes use of light emitted by a high pressure discharge lamp, and it may also be called an illuminating device. Therefore, various light projecting devices, such as liquid crystal projectors and overhead projectors, vehicle headlights, luminaires and displays are all included in the category of light source devices. of course, it does not matter whether the aforementioned luminaires are designed to be used indoors or outdoors.

With the configuration as above, the present invention provides a light source device which is ensured of functioning to the end of its life and has improved rising characteristics of the luminous flux and excellent performance characteristics in start-up and restart-up of the high pressure discharge lamp.

PREFERRED EMBODIMENT OF THE INVENTION

Next, an embodiment of the present invention is explained hereunder, referring to a drawing.

Figure 1:
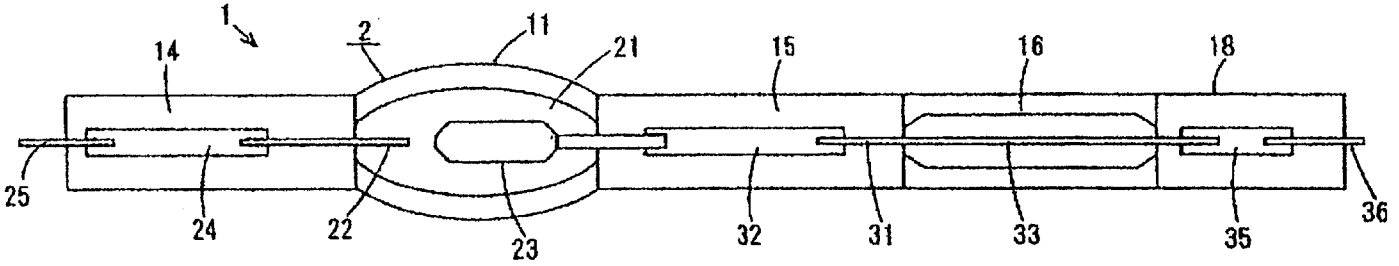
FIG. 1 is a sectional view of an embodiment of the high pressure discharge lamp of the present invention.

Referring to FIG. 1, numeral 1 denotes a high pressure discharge lamp, which may be a short-arc metal halide lamp adapted to function as a discharge lamp. The high pressure discharge lamp 1 is provided with a bulb, which is an arc tube 2 made of quartz glass. The arc tube 2 comprises a discharge casing 11 and a pair of first sealed portions 14,15 that sandwich the discharge casing 11. In the description hereunder, one of the first sealed portions is referred to as the cathode-side sealed portion 14, and the other first sealed portion is referred to as the anode-side sealed portion 15. A middle chamber 16 is formed adjacent to the anode-side first sealed portion 15, and a second sealed portion 18 is formed adjacent to the middle chamber 16.

As it is also called a vacuum container, the discharge casing 11 has a hollow, spherical shape. Its hollow inside is formed into a discharge space 21. Disposed in the discharge space 21 are a pair of electrodes 22,23, which are arranged opposite each other. When in use, these electrodes perform a DC discharge by using direct current supplied from a DC power supply (not shown), with one of the electrodes functioning as the cathode 22 and the other as the anode 23.

The cathode 22 may be made of a thoriated-tungsten alloy containing thorium and has a thickness of 0.7 mm. The cathode 22 is positioned such that one of its end, i.e. the tip, is located in the discharge space 21 of the vacuum container 11, while the other end reaches the cathode-side first sealed portion 14, in other words the base end of the cathode, and is affixed to the cathode-side first sealed portion 14.

The anode 23 is formed of tungsten with a thickness of 2.6 mm. In the same manner as the cathode 22, an end, i.e. the tip, of the anode 23 is located in the discharge space 21 of the discharge casing 11, while the other end that reaches the anode-side first sealed portion 15, in other words the base end, is affixed to the anode-side first sealed portion 15.

A metal foil conductor 24 made of molybdenum is embedded in the cathode-side first sealed portion 14. An end of the metal foil conductor 24 is welded and thus connected to the cathode 22, while the other end of the conductor 24 is welded and connected to a lead wire 25 made of molybdenum. The metal foil conductor 24 is in the shape of a rectangular plate having a width of 3 mm and a length of 13 mm. According to the pinch-sealing method, the metal foil conductor 24 is pushed into the cathode-side first sealed portion 14 so that the metal foil conductor 24 is fastened and airtightly sealed in the cathode-side first sealed portion 14 together with its welded portions.

Likewise, a metal foil conductor 32 which constitutes a lead portion 31 and made of molybdenum serving as a conductor is embedded in the anode-side first sealed portion 15. An end of the metal foil conductor 32 is welded and thus connected to the anode 23, while the other end of the conductor 32 is welded and connected to a lead wire 33, which is made of molybdenum and extends in a straight line. The metal foil conductor 32 is in the shape of a rectangular plate having a width of 3 mm and a length of 13 mm. The anode-side first sealed portion 15 is 23 mm long. In the same manner as above, the metal foil conductor 32 is pushed into the anode-side first sealed portion 15 together with its welded portions so as to be fastened and airtightly sealed in the anode-side first sealed portion 15 by the pinch-sealing method.

The middle chamber 16, which is formed adjacent to the anode-side first sealed portion 15, is hollow. As described above, the lead wire 33 is affixed to the metal foil conductor 32 with one of the end of the lead wire 33 welded to the conductor 32. The other end of the lead wire 33 passes through the middle chamber 16 into the second sealed portion 18. A metal foil conductor 35 made of molybdenum that serves as a conductor is embedded in the second sealed portion 18. The metal toil conductor 35 is connected to the lead wire 33 and a molybdenum lead wire 36, with one of the end of the metal foil conductor 35 welded to the lead wire 33 and the other end welded to the lead wire 36. The metal foil conductor 35 is in the shape of a rectangular plate having a width of 3 mm and a length of 10 mm. The second sealed portion 18 is in the shape of a rectangular plate having a length of 13 mm. Together with its welded portions, the metal foil conductor 35 is pushed into the second sealed portion 18 so as to be fastened and airtightly sealed in the second sealed portion 18 by the pinch-sealing method.

According to the present embodiment, the distance from the center of the arc, i.e. the source of heat, in the discharge space 21 to the end of the second sealed portion 18 is approximately 65 mm.

The discharge space 21 of the discharge casing 11 of the high pressure discharge lamp 1 according to the embodiment contains a sufficient quantity of mercury to obtain a given lamp voltage. The discharge space 21 is also filled with argon gas at a pressure of about 40 kpa.

The middle chamber 16 is filled with argon gas.

The high pressure discharge lamp 1 according to the present embodiment has the structure described above, wherein the second sealed portion 18 is sealed by the pinch-sealing method so that the middle chamber 16 is maintained in a perfectly airtight state to prevent the argon gas from flowing out of the middle chamber 16. The distance from the center of the arc, which serves as the source of heat, to the end of the second sealed portion 18 is approximately 65 mm, which is considerably longer compared with a conventional small high pressure discharge lamp. The present embodiment thus provides a structure where the sealing portion is at a sufficiently long distance from the heat source. This structure makes it difficult for the heat to be conducted from the heat source to the portions at which the metal foil conductor 35 is welded to the lead wires 33,36 and consequently reduces the rate of increase in the temperature of the welded portions, making the welded portions less prone to oxidation even if the welded portions are exposed to air.

The distance between the anode-side first sealed portion 15 and the heat source is basically the same as that of a conventional discharge lamp. Therefore, when the arc tube 2 is used for a long period of time, the temperature of the respective portions where the metal foil conductor 32 is welded to the anode 23 and the lead wire 33 increases with the increase in temperature of the metal foil conductor 32. However, as no atmosphere but the chemically stable argon gas that is sealed in the middle chamber is permitted to enter this part of the lamp, there is no possibility of corrosion taking place at the portion where the metal foil conductor 32 is welded to the lead wire 33.

As described above, the present embodiment provides a small high pressure discharge lamp 1 where the distance from the heat generating point to the second sealed portion 18 can be set at a desired length, thereby limiting heat conduction from the heat generating point to the portions at which the metal foil conductor 35 is welded to the lead wires 33,36, reliably preventing breakage of the welded portions, and consequently ensuring a desired life span.

Figure 2:
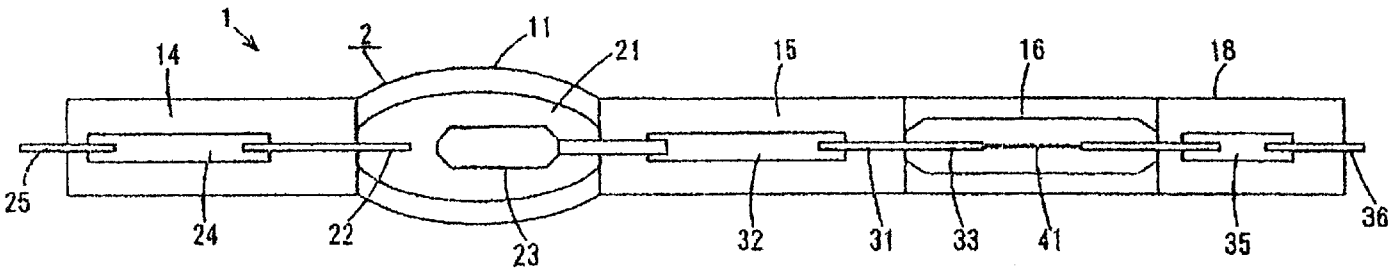
FIG. 2 is a sectional view of another embodiment of the high pressure discharge lamp of the present invention.

Next, a second embodiment of the present invention is explained hereunder, referring to FIG. 2.

As the structure of a high pressure discharge lamp 1 according to the second embodiment is similar in most parts to that of the embodiment described above and shown in FIG. 1, the elements corresponding to those in FIG. 1 are identified with the same reference numerals, explanation of which is omitted herein.

The structure shown in FIG. 2 is different from the structure of the embodiment shown in FIG. 1 in that a lead wire 33, which is provided with a straight filament 41, passes through the middle chamber 16 and is connected to metal foil conductors 32,35.

The filament 41 is made of tungsten, and its capacity is set such that the filament fuses after serving for a preset period of time that is shorter than the rated life of the lamp.

A high pressure discharge lamp 1 according to the present invention has a structure as described above. When in use, the temperature of the metal foil conductor 32 increases due to the heat generated by the discharge arc, and the temperature of the filament 41 in the middle chamber 16 also increases accordingly. During the increase of the temperature of the metal foil conductor 32, when the filament 41 reaches the end of its life, which is shorter than the rated life of the lamp, the filament 41 fuses. As a result of the fusion of the filament 41, the current flowing through the lead wire 33 is interrupted so that the DC discharge that has been in progress inside the discharge casing 11 with the current supplied from the DC power supply (not shown) is halted.

Normally, the luminosity of a high pressure discharge lamp gradually decreases with the elapse of time that the lamp is lit; it does not become darker all of a sudden. Therefore, it o;ten happens that a high pressure discharge lamp which has been in use over a long period of time reaches and exceeds its rated life. A high pressure discharge lamp near the end of its life presents the danger of burst of the discharge casing.

In order to prevent such an occurrence, the filament 41 that is a part of the DC circuit is caused to fuse during its usable life, which is determined by the material of the filament. Setting the usable life of the filament 41 shorter than the rated life of the lamp enables the prevention of burst of the discharge casing 11 or other unexpected malfunctions of the lamp that may otherwise occur at the end of the life of the high pressure discharge lamp 1 and require complicated or inconvenient repair. In other words, according to the above structure, fusion of the filament 41 permits the user of the high pressure discharge lamp 1 to know that the lamp is near the end of its life and replace the currently used high pressure discharge lamp 1 with a new high pressure discharge lamp 1.

The appropriate time for replacing a high pressure discharge lamp with a new lamp has conventionally been determined by assumption based on data accumulated from actual use of other lamps in the past, such as the temperature of the metal foil conductor attached to the sealed portion that is exposed to the outside air and the life span of said conductor, which is prone to deterioration due to oxidation; for example, figures such as a life span of 2,000 hours and a temperature of 300° C. may be used. However, there is a wide variance in the conditions in which lamps are used.

Should an abnormal discharge occur in the discharge casing 11, however, the arc tube 2 of the embodiment described above is capable of detecting the current resulting from such an abnormal discharge and turning off the lamp, thereby preventing a burst of the high pressure discharge lamp.

As described above, the present embodiment prevents a sudden burst of the discharge casing 11, which may otherwise occur at the end or the life of the high pressure discharge lamp 1 and cause an unexpected malfunction of the apparatus equipped with the high pressure discharge lamp 1.

Figure 3:
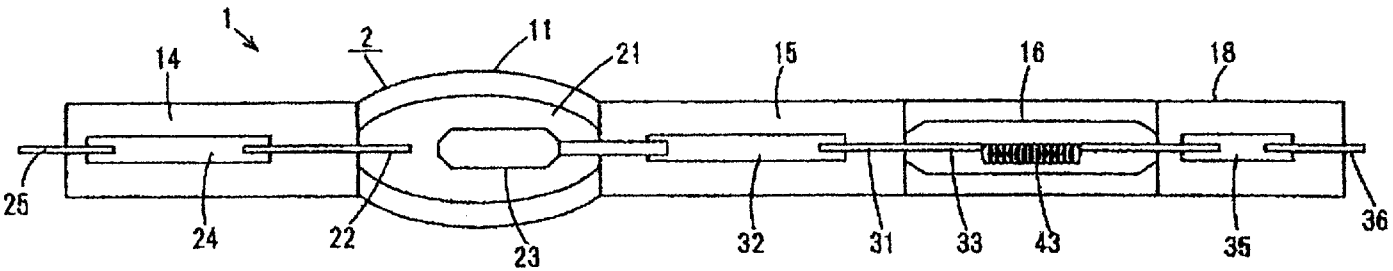
FIG. 3 is a sectional view of yet another embodiment of the high pressure discharge lamp of the present invention.

Next, a third embodiment of a high pressure discharge lamp according to the invention is explained hereunder, referring to FIG. 3.

As the structure of a high pressure discharge lamp 1 according to the third embodiment is similar in most parts to that of the embodiment described above and shown in FIG. 1, the elements corresponding to those in FIG. 1 are identified with the same reference numerals, explanation of which is omitted herein.

The structure shown in FIG. 3 is different from the structure of the embodiment shown in FIG. 1 in that a lead wire 33, which is provided with a coiled filament 43, passes through the middlechamber 16 and is connected to metal foil conductors 32,35.

In this embodiment, too, the capacity of the coiled filament 43 is set such that the filament fuses after being used for a given period of time that is shorter than the rated life of the lamp. The filament 43 is made of a tungsten filament material.

With the configuration as above, a high pressure discharge lamp 1 according to the invention, which is provided with a filament 43 similar to the filament 41 of the previously mentioned embodiment, is designed such that the filament 43 fuses when the filament 43 reaches the end of its life during the course of use of the lamp, said life of the filament 43 having been so Bet beforehand as to be shorter than the rated life of the lamp. As a result of the fusion of the filament 43, the DC discharge that has been in progress inside the discharge casing 11 with the current supplied from the DC power supply is halted.

As described above, the present embodiment, too, prevents a sudden burst of the discharge casing 11, which may otherwise occur at the end of the life of the high pressure discharge lamp 1 and cause an unexpected malfunction of the apparatus equipped with the high pressure discharge lamp 1.

Figure 4:
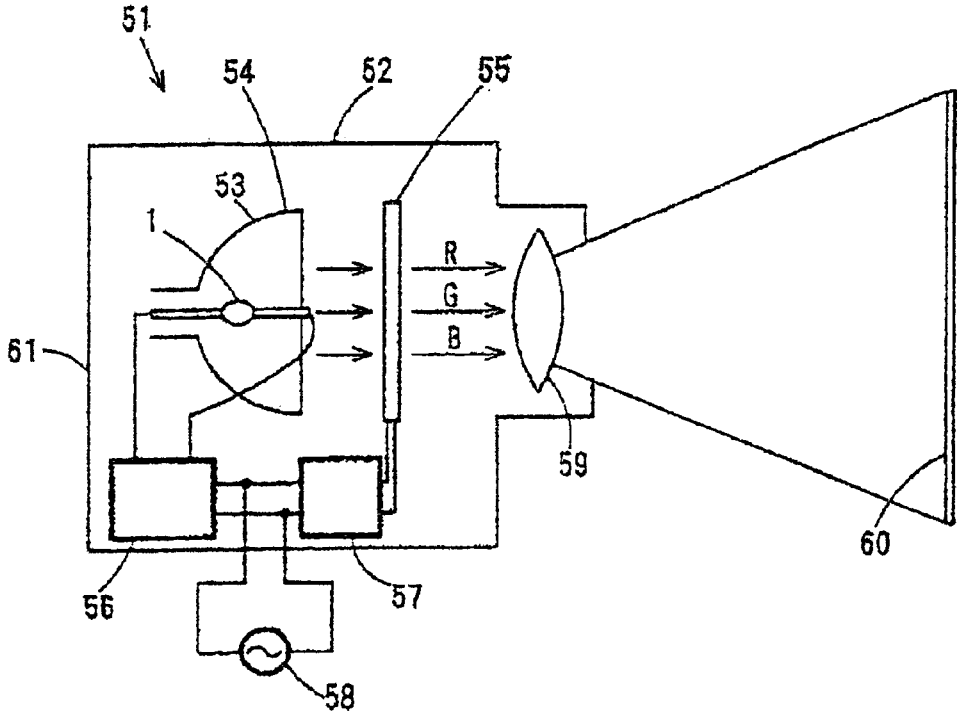
FIG. 4 is a system diagram of an embodiment of the light source device including a high pressure discharge lamp device of the present invention.

Next, a high pressure discharge lamp device and a light projecting device according to an embodiment of the invention is explained hereunder, referring to FIG. 4.

Referring to FIG. 4, numeral 51 denotes a liquid crystal projector serving as a light source device. The main body 52 of the liquid crystal projector 51 is provided with a high pressure discharge lamp device 54 comprised of a reflecting mirror 53, which serves as a reflector, and a high pressure discharge lamp 1 according to the embodiment shown in FIG. 1. Rays of light emitted by the high pressure discharge lamp 1 are converged by the reflecting mirror 53 and projected onto a liquid crystal panel 55 which serves as a display means, i.e. a liquid crystal image display means. A lamp lighting device 56 incorporating a rectifying means is connected to the high pressure discharge lamp 1. An image control means 57 is connected to the liquid crystal panel 55. The lamp lighting device 56 and the image control means 57 are connected to an AC power supply 58 in order to supply them with necessary power. A projection lens 59 is disposed in front of the liquid crystal panel 55. The liquid crystal panel 55 is irradiated with the light that has been projected forward by the reflecting mirror 53 so that an image formed of the three primary colors R,G,B by the liquid crystal panel 55 is projected through the projection lens 59 onto a screen 60. All of these components, except for the screen 60, are contained in a main body casing 61.

As these liquid crystal projector 51, which serves as the light source device and the high pressure discharge lamp device 54 include a high pressure discharge lamp 1 described above, they have the same effect as that of the high pressure discharge lamp 1. Therefore, they are capable of, for example, ensuring a preset life span and preventing a sudden malfunction.

Figure 5:
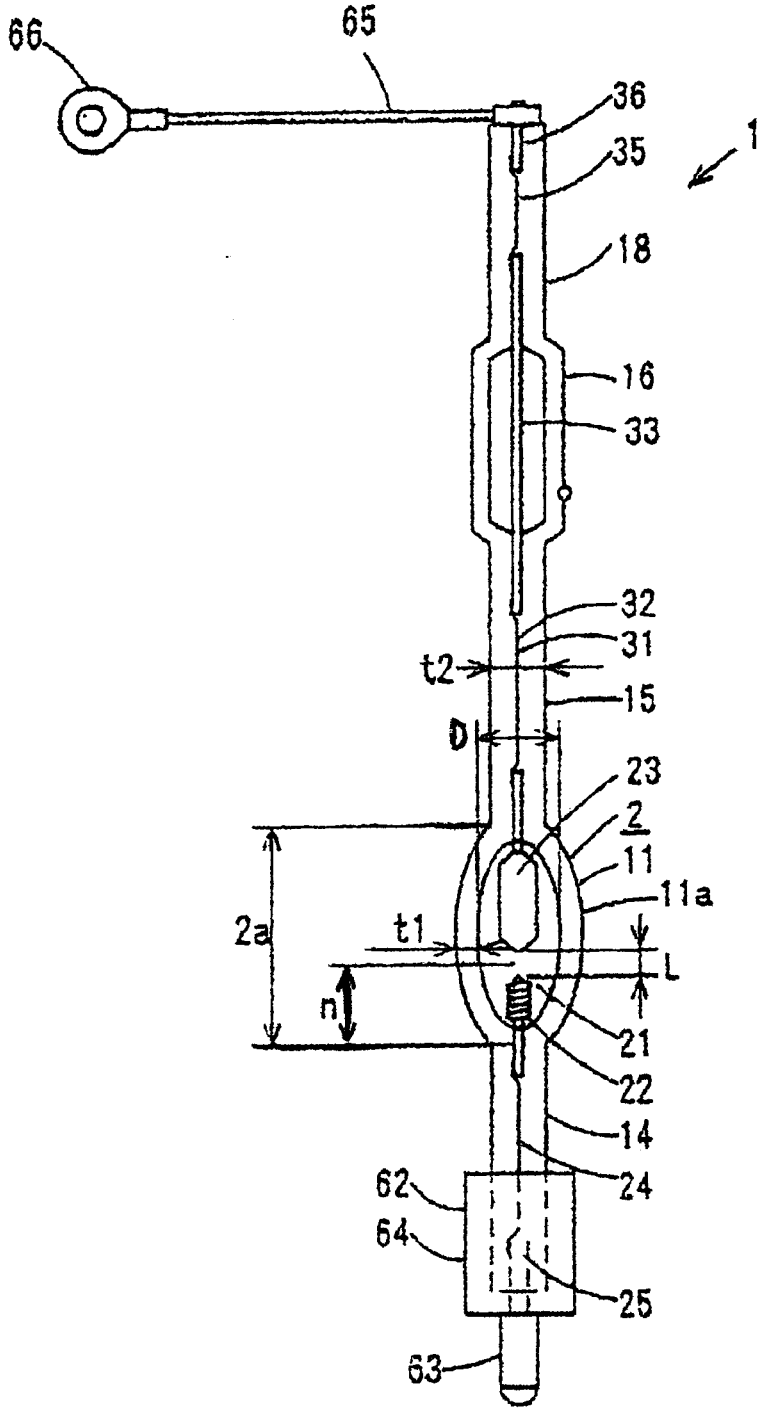
FIG. 5 is a sectional view of yet another embodiment of the high pressure discharge lamp of the present invention.
Figure 6:
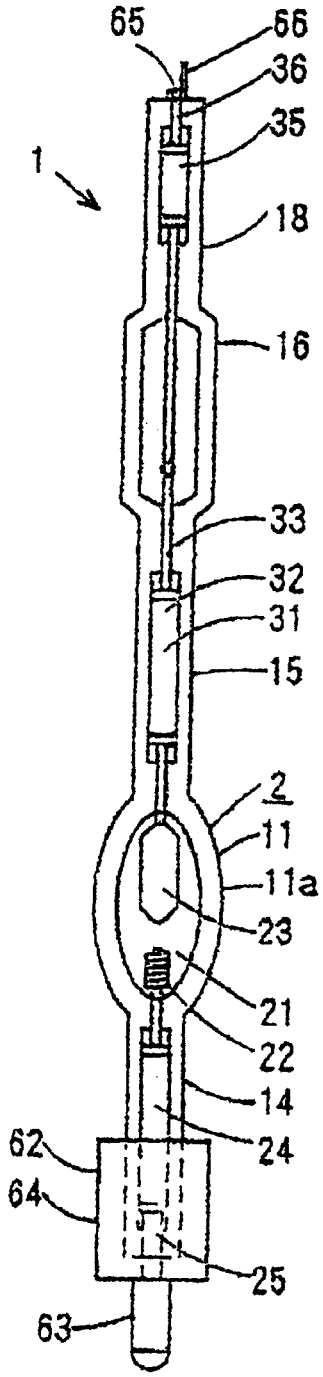
FIG. 6 is a side view of said high pressure discharge limp.
Figure 7:
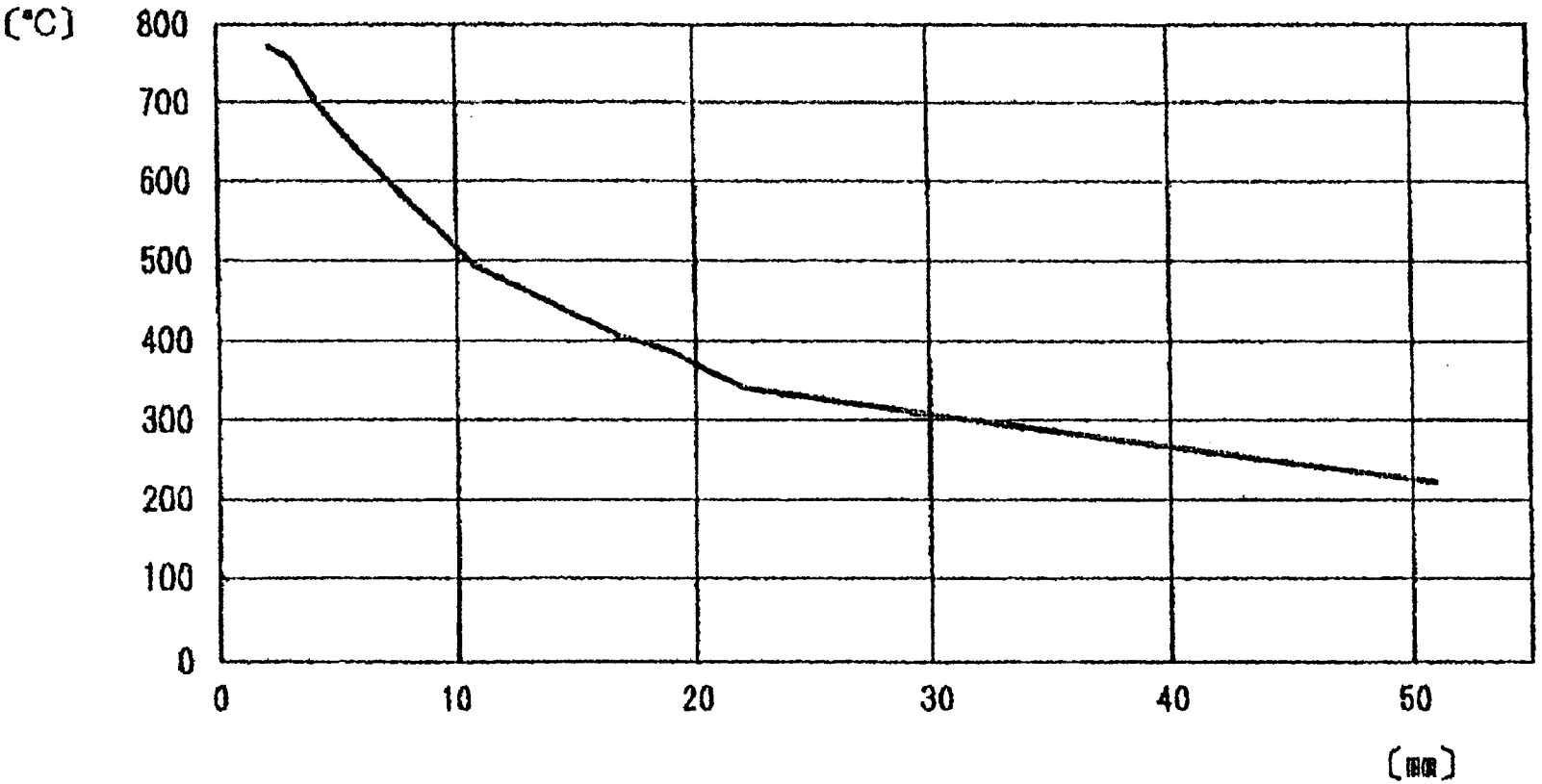
FIG. 7 is a characteristic graph showing the relationship between distance from the surface of the arc tube and temperature.

Next, a fourth embodiment of the high pressure discharge lamp 1 according to the invention is explained hereunder, referring to FIGS. 5 and 6.

The high pressure discharge lamp 1 is adapted to be used in the vertical position, as viewed in the drawings. The high pressure discharge lamp 1, may be a short-arc type metal halide lamp serving as a discharge lamp. The high pressure discharge lamp 1 is provided with a bulb, which is an arc tube 2 made of quartz glass. The arc tube 1 comprises a discharge casing 11 and a pair of first sealed portions 14, 15 that sandwich the discharge casing 11. In the description hereunder, the lower first sealed portion is referred to as the cathode-side sealed portion 14, while the upper first sealed portion is referred to as the anode-side sealed portion 15. A middle chamber is formed adjacent to the anode-side first sealed portion 15, and a second sealed portion 18 is formed adjacent to the middle chamber 16.

As it is also called a vacuum container, the discharge casing 11 has a hollow, spherical convex portion 11*a*, the hollow inside or which is formed into a discharge space 21. The discharge space 21 is filled with a discharge medium that contains mercury. The discharge space 21 is also provided with a pair of electrode units respectively disposed at the two opposing ends of the discharge casing 11. The electrode units include a pair of electrodes 22,23 arranged opposite each other. When in use, these electrodes perform DC discharge by using direct current supplied from a DC power supply (not shown), with one of the electrodes functioning as the cathode 22 and the other as the anode 23.

The cathode 22 is positioned such that one of its end, i.e. the tip, is located in the discharge space 21 of the discharge casing 11, while the other end that reaches the cathode-side first sealed portion 14, i.e. the base end of the cathode, is affixed to the cathode-side first sealed portion 14. According to the present embodiment, a coil is wound around the outer surface of the cathode 22 in order to limit increases of temperature, thereby preventing vaporization of tungsten or other material that forms the cathode.

In the same manner as the cathode 22, an end, i.e. the tip, of the anode 23 is located in the discharge space 21 of the discharge casing 11, while the other end that reaches the anode-side first sealed portion 15, i.e. the base end, is affixed to the anode-side first sealed portion 15.

A metal foil conductor 24 made of molybdenum is embedded in the cathode-side first sealed portion 14. An end of the metal foil conductor 24 is welded and thus connected to the cathode 22, while the other end of the conductor 24 is welded and connected to a lead wire 25 made of a molybdenum wire. According to the pinch-sealing method, the metal foil conductor 24 is pushed into the cathode-side first sealed portion 14 together with its welded portions so as to be fastened and airtightly sealed therein.

Likewise, a metal foil conductor 32 which constitutes a lead portion 31 and made of molybdenum serving as a conductor is embedded in the anode-side first sealed portion 15. An end of the metal foil conductor 32 is welded and thus connected to the anode 23, while the other end of the conductor 32 is welded and connected to a lead wire 33 which is Made of molybdenum and extends in a straight line. Together with its welded portions, the metal foil conductor 32 is pushed into the anode-side first sealed portion 15 so as to be fastened and airtightly sealed in the anode-side first sealed portion 15 by the pinch sealing method.

The middle chamber 16 formed adjacent to the anode-side first seated portion 15 is hollow. As described above, the lead wire 33 is affixed to the metal foil conductor 32 with one of its end welded to the conductor 32. The other end of the lead wire 33 extends through the middle chamber 16 into the second sealed portion 18. A metal foil conductor 35 made of molybdenum that serves as a conductor is embedded in the second sealed portion 18. The metal foil conductor 35 is connected to the lead wire 33 and a molybdenum lead wire 36, with one of its end welded to the lead wire 33 and the other end welded to the lead wire 36. The metal foil conductor 35 is pushed into the second sealed portion 18 together with its welded portions by the pinch-sealing method so as to be fastened and sealed in the second sealed portion 18 in an airtight state. The middle chamber 16 is filled with an inert gas, such as argon gas.

According to the present embodiment, a base 64 having an insulated tubular body 62 and a tube pin 63 is attached to the end of the cathode-side first sealed portion 14 and connected to the lead wire 25. A wire portion 65 having insulation coating is attached to the end of the second sealed portion 18 and connected to a lead wire 36. The other end of the wire portion 65 is connected to an annular connector portion 66.

The inner diameter of the convex portion 11*a*, i.e. the inner diameter of the discharge space 21, is represented by D and the wall thickness is represented by t1. The thickness of the seal portion at which the electrode shaft of the anode 23 is sealed, in other words the thickness of the anode-side first sealed portion 15 serving as the electrode shaft seal portion, is represented by t2. The vertical length of the outer wall of the convex portion 11*a* is represented by 2*a*; the distance between the anode 23 and the cathode 22 is represented by L, and the distance from the midpoint of the distance between the two electrodes to the lower outer end of the convex portion 11*a* is represented by n. On these conditions, the relationship among them are set such that:

$$0.29 \leqq \{(a-n)/L\} \leqq 2.7$$

$$5L \leqq D$$

A concrete example is offered as follows: the discharge space 21 has an inner diameter D of 8 mm, the longer axis with a length of 12 mm, a wall thickness of the convex portion 11*a*, i.e. t*i*, of 2 mm, and a bulb wall loading of 55 $W/cm_2$. The electrodes are made of tungsten, with the diameters of the cathode 22 and the anode 23 being 0.7 mm and 2.0 mm respectively. The metal foil conductor 24 embedded in the cathode-side first sealed portion 14 is made of molybdenum (Mo) and has a width of 2 mm and a length of 15 mm. The metal foil conductor 32 embedded in the anode-side first sealed portion 15 is also made of molybdenum (Mo) and has a width of 2 mm and a length of 15 mm. Furthermore, the anode-side first sealed portion 15 serving as the electrode shaft seal portion has a thickness t2 of 3 mm and a width of 7 mm so that the wall thickness t1 of the convex portion 11*a* and the wall thickness t2 of the electrode shaft seal portion are set such that their relationship is represented by t1>(t2/2), i.e. 2>(3/2).

A sufficient quantity of mercury (Hg) to obtain a given lamp voltage is sealed in the discharge space of the convex portions 11*a*. To be more specific, 40 mg/cc of mercury per unit volume is sealed in the discharge space. The discharge space is also filled with argon (Ar) gas at a pressure of about 40 kpa.

As a result of setting the dimensions of said components in such a range as t1>(t2/2), the embodiment enables the production of a small, high-efficiency lamp of a chip-less, short-gap type by the pinching method. Producing such a lamp by the pinching method was impossible according to the conventional art.

The high pressure discharge lamp 1 having such a structure as described above is used in the vertical position shown in the drawings. In case of the present embodiment, the high pressure discharge lamp 1 is used in the vertical position with the cathode 22 below the anode 23. The relationship among the dimensions of the components of the lamp fulfill the conditions of $0.29 \leqq \{(a-n)/L\} \leqq 2.7$ and $5L \leqq D$, wherein the distance between the upper end and the lower end of the convex portion 11*a* is represented by 2*a*; the distance between the lower outer end of the convex portion 11*a* and the midpoint between the anode 23 and the cathode 22 by n, the distance between the anode 23 and the cathode 22 by L, and the inner diameter of the discharge space in the convex portion 11*a* by D. Therefore, the present embodiment is capable of reducing the expansion of the convex portion 11*a*, in other words the possibility of a burst of the convex portion 11*a*, during the time that the lamp is lit in the vertical position and also ensures reliable functioning of the lamp in desired performance characteristics to the end of its life. Should the lamp have such dimensions as $\{(a-n)/L\}<0.29$, the distance L between the electrodes is too long to fulfill the condition of $5L \leqq D$; if the inner diameter of the discharge space 21 is set to be $5L \leqq D$ in this condition, the inner diameter D, too, becomes so great that it is difficult to provide a small lamp. On the other hand, setting the dimension D in the range of 5L>D without fulfilling the condition of 5L>D results in expansion of the convex portion 11*a* due to the heat of arc discharge, because the inner diameter D of the discharge space 21 is relatively short with respect to the long arc.

Should the lamp have such dimensions as $\{(a-n)/L\}>0.27$, the distance L between the electrodes is too short to obtain desired light generation characteristics while fulfilling the condition of $5L \leqq D$ at the same time. On the other hand, setting the dimension D' in the range of 5L>D without fulfilling the condition of $5L \leqq D$ results in expansion of the convex portion 11*a* due to the heat of arc discharge, because the arc is too close to the wall of the convex portion 11*a*.

Merely fulfilling the condition of $0.29 \leqq \{(a-n)/L\} \leqq 2.7$ is not sufficient; should the condition of $5L \leqq D$ be not fulfilled, there is the possibility of expansion, and, consequently, burst of the convex portion 11*a*. In order to offer concrete examples, five each samples (Sample Nos. 1 through 5) of Type A and Type B were prepared, wherein each sample of Type A fulfilled the criteria of $0.29 \leqq \{(a-n)/L\} \leqq 2.7$ and $5L \leqq D$ (D=8.5 mm, L=1.5 mm, a=9 mm and n=7 mm), while each sample of Type B fulfilled the criterion of $0.29 \leqq \{(a-n)/L\} \leqq 2.7$ but not $5L \leqq D$ (D=6.5 mm, L=1.5 mm, a=9 mm and n=7 mm). Then, a life-span test was conducted on each sample.

As it is evident from the test results shown in Table 1, no sample of Type A presented any malfunction even after the elapse of 2,000 hours. With regard to the samples of Type B, the convex portion 11*a* of each one of the three samples, i.e. Nos. 1 to 3, became expanded after the elapse of 100 hours; Sample No. 4 broke in 300 hours; and the convex portion 11*a* of Sample No. 5 became expanded in 200 hours.

TABLE 1

| | Type A | Type B |
|---|---|---|
| Sample No. 1 | Exceeded 2000 hrs | Expanded within 100 hrs |
| Sample No. 2 | Exceeded 2000 hrs | Expanded within 100 hrs |
| Sample No. 3 | Exceeded 2000 hrs | Expanded within 100 hrs |
| Sample No. 4 | Exceeded 2000 hrs | broke within 300 hrs |
| Sample No. 5 | Exceeded 2000 hrs | Expanded within 100 hrs |

Because the lamp according to the present embodiment is lit in the vertical position, the temperature distribution in the convex portion 11*a* can easily be made uniform. When the lamp is lit, the arc beat generates a convection current of the gas in the discharge space 21. In cases where the lamp is lit in the horizontal position, the convection of the gas causes the arc to curve in a convex and be brought close to the top of the tube wall of the convex portion 11*a*. As a result, the temperature distribution in the convex portion 11*a* becomes nonuniform and may involve various undesirable consequences, such as an expansion of the convex portion 11*a*. In cases where the lamp is lit in the vertical position, even if a convection current of the gas is generated in the discharge space 21, the arc is maintained straight so that the temperature distribution in the convex portion 11*a* is symmetrical with respect to the vertical center line of the convex portion 11*a*. Therefore, lighting the lamp in the vertical position has another benefit in that it prevents the wall of the convex portion 11*a* from being heated particularly at a limited area.

According to the fourth embodiment shown in FIGS. 4 and 5, the lamp is positioned such that the middle chamber 16 is located above the discharge space 21 serving as the heat generating portion. By thus providing a sufficient distance from the heat generating portion to the second sealed portion 18, the embodiment reduces the heat conducted to the portions at which the lead wires 33,35 are welded to the metal foil conductor 35, which is located at the upper part of the lamp and therefore prone to being heated during the time that the lamp is lit. Thus, the embodiment protects said welded portions from undesirable breakage. Furthermore, as the lamp is lit in the position where the anode 23 is located above the cathode 22, vaporization of the mercury that has condensed around the cathode 22, which is the portion of the arc tube with the lowest temperature, is accelerated by the cathode 22, whose temperature is rapidly increased when the lamp is turned on. As a result, rising characteristics of the luminous flux of the high pressure discharge lamp are improved.

When using the above embodiment, it is desirable to set the distance L between the two electrodes in the range of 1.0 to 3.0 mm and the lamp power in the range of 150 to 250 W. When used in the vertical position under these conditions, the high pressure discharge lamp 1 functions with an intense luminance.

Next, yet another embodiment of the high pressure discharge lamp according to the invention is explained, referring to the relevant drawings.

Figure 8:
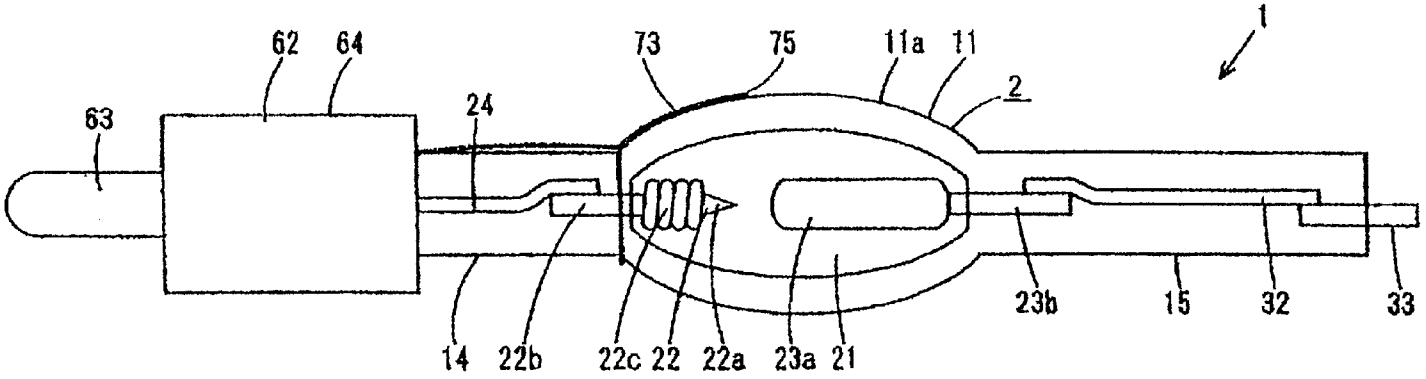
FIG. 8 is a front view of yet another embodiment of the high pressure discharge lamp of the present invention.
Figure 9:
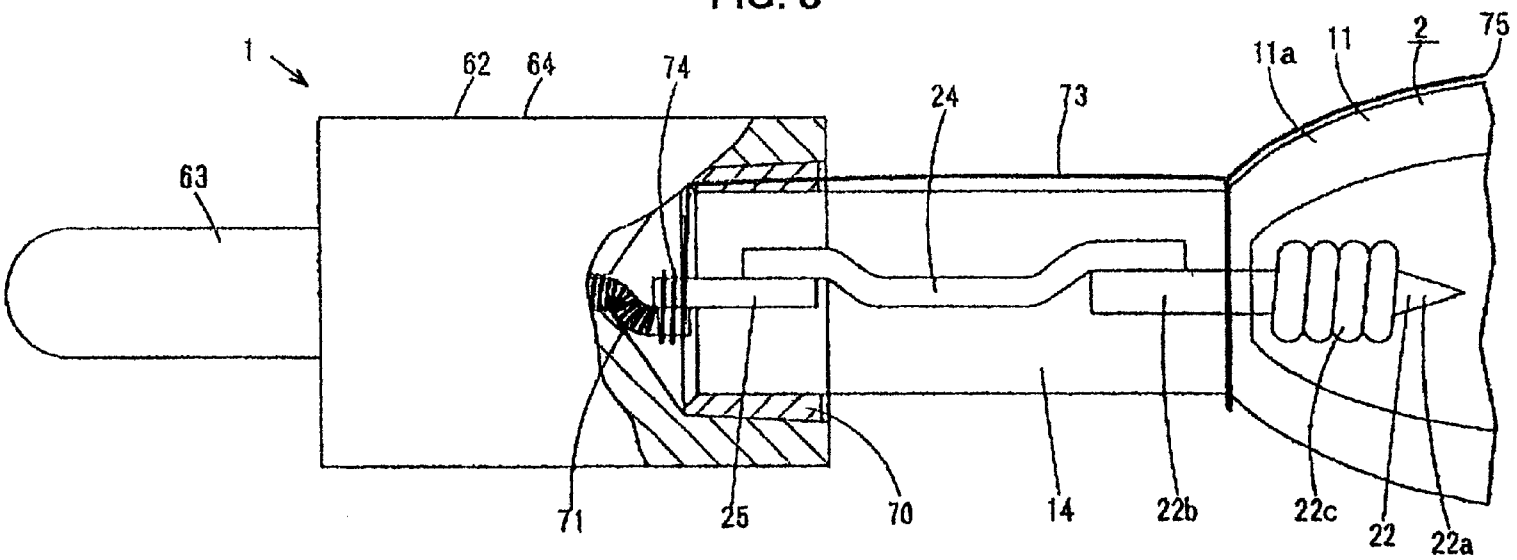
FIG. 9 is a partially-cutaway enlarged front view of a part of said high pressure discharge lamp.

FIG. 8 is a front view of the fifth embodiment of the high pressure discharge lamp of the present invention, and FIG. 9 is a partially-cutaway enlarged front view of a part of said high pressure discharge lamp.

The high pressure discharge lamp 1 shown in FIGS. 8 and 9 may be a short-arc metal halide lamp adapted to function as a discharge lamp. The high pressure discharge lamp 1 is provided with a bulb, which is an arc tube 2 made of quartz glass. The arc tube 1 comprises a discharge casing 11 and a pair of first sealed portions 14,15 that are integrally formed with the discharge casing 11 and sandwich the same. In the description hereunder, one of the first sealed portions is referred to as the cathode-side sealed portion 14, and the other first sealed portion is referred to as the anode-side sealed portion 15. The cathode-side first sealed portion 14 and the anode-side first sealed portion 15 are respectively 13 mm and 23 mm long.

The discharge casing 11, which is also called a vacuum container, is made of quartz glass and has a hollow, spindle-shaped convex portion 11*a*, the inside of which is formed into a discharge space 21. The discharge space 21 is filled with a discharge medium that consists of argon and mercury, wherein the argon is contained at 40 kPa. The discharge space 21 is also provided with a pair of electrode units respectively disposed at the two opposing ends of the discharge casing 11. The electrode units include a pair of electrodes 22,23 arranged opposite each other. When in use, these electrodes perform a DC discharge by using direct current supplied from a DC power supply (not shown), with one of the electrodes functioning as the cathode 22 and the other as the anode 23.

The cathode 22 is made of tungsten and has a cathode essential portion 22*a* and an electrode shaft 22*b*. The cathode essential portion 22*a* is formed by shaping an end of the electrode shaft 22*b*, which has a diameter of 0.7 mm, into a sharply angled tip and winding a tungsten coil 22*c* around the wall of the portion near the tip in order to limit increases of temperature, thereby preventing vaporization of the material that forms the cathode, such as tungsten. The cathode 22 is positioned such that one of its end, i.e. the end of the cathode essential portion 22*a*, is located in the discharge space 21 of the discharge casing 11, while the other end that reaches the cathode-side first sealed portion 14, i.e. the base end of the electrode shaft 22*b*, is loosely inserted into the cathode-side first sealed portion 14 and supported by the discharge casing 11.

The anode 23 is made of tungsten and has an anode essential portion 23*a* and an electrode shaft 23*b*. The anode essential portion 23*a* has a diameter of 2.6 mm and is supported at the end of the electrode shaft 23*b*. In the same manner as the cathode 22, an end of the anode 23, i.e. the tip of the anode essential portion 23a, is located in the discharge space 21 of the discharge casing 11, while the other end that reaches the anode-side first sealed portion 15, i.e. the base end of the electrode shaft 23*b*, is loosely inserted into the anode-side first sealed portion 15 and supported by the discharge casing 11.

A metal foil conductor 24 made of molybdenum is airtightly embedded in the cathode-side first sealed portion 14. The metal foil conductor 24 is also referred to as a sealed metal foil and has a width of 3 mm and a length of 10 mm. An end of the metal foil conductor 24 is welded and thus connected to the electrode shaft 22*b* of the cathode 22, while the other end of the conductor 24 is welded and connected to a lead wire 25, which is an external lead wire made of molybdenum. According to the pinch-sealing method, the metal foil conductor 24 is pushed into the cathode-side first sealed portion 14 together with its welded portions so as to be fastened and airtightly sealed therein.

Likewise, a metal foil conductor 32 made of molybdenum serving as a conductor is airtightly embedded in the anode-side first sealed portion 15. The metal foil conductor 32 is also referred to as a sealed metal foil and formed of a molybdenum foil having a width of 3 mm and a length of 13 mm. An end of the metal foil conductor 32 is welded and thus connected to the electrode shaft 23*b* of the anode 23, while the other end of the conductor 32 is welded and connected to a lead wire 33 which is an external lead wire made of molybdenum. In the same manner as the he metal foil conductor 24, the metal foil conductor 32 is pushed into the anode-side first sealed portion 15 together with its welded portions by the pinch-sealing method so as to be fastened and sealed in the anode-side first sealed portion 15 in an airtight state.

The lead wires 25,23 are respectively drawn out of the two sealed portions 14,15 of the arc tube 2 to the outside of the arc tube.

A base 64 having an insulated tubular body 62 and a tube pin 63, which serves as the cathode terminal, is attached to the end of the cathode-side first sealed portion 14 and connected to the lead wire 25, which leads out of the cathode-side first sealed portion 14 to the outside. The insulated tubular body 62 is made of stainless steel and fastened at one of its end to the corresponding end of the cathode-side first sealed portion 14 by means of base cement 70. The tube pin 63 protrudes from the other end of the insulated tubular body 62 and, inside the insulated tubular body 62, is connected to the lead wire 25 through a twisted wire 71.

Numeral 73 denotes a starting conductor, which is a metal wire made of an aluminum-chrome alloy. With the base end of the starting conductor 73 wound around the portion at which the cathode-side lead wire 25 and the twisted wire 71 are welded together, the starting conductor 73 is connected to the cathode 22 so as to have the same electrical potential as the cathode 22.

The middle part of the starting conductor 73 leads out of the base 64 and extends along the cathode-side first sealed portion 14. After being wound once around the borderline between the cathode-side first sealed portion 14 and the convex portion 11*a*, in other words between the cathode-side first sealed portion 14 and the discharge space 21, so as to be secured to the translucent discharge casing 11, the starting conductor 73 extends in a curve along the discharge space 21. The end 75 of the starting conductor 73 is positioned somewhere between the cathode 22 and the anode 23.

Figure 10:
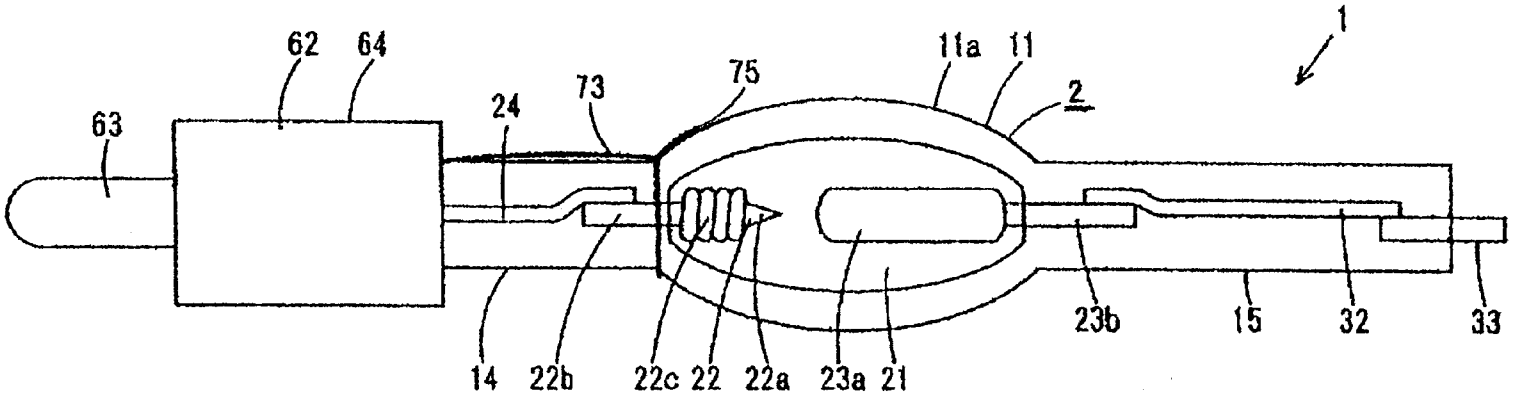
FIG. 10 is a front view of yet another embodiment of the high pressure discharge lamp of the present invention.
Figure 11:
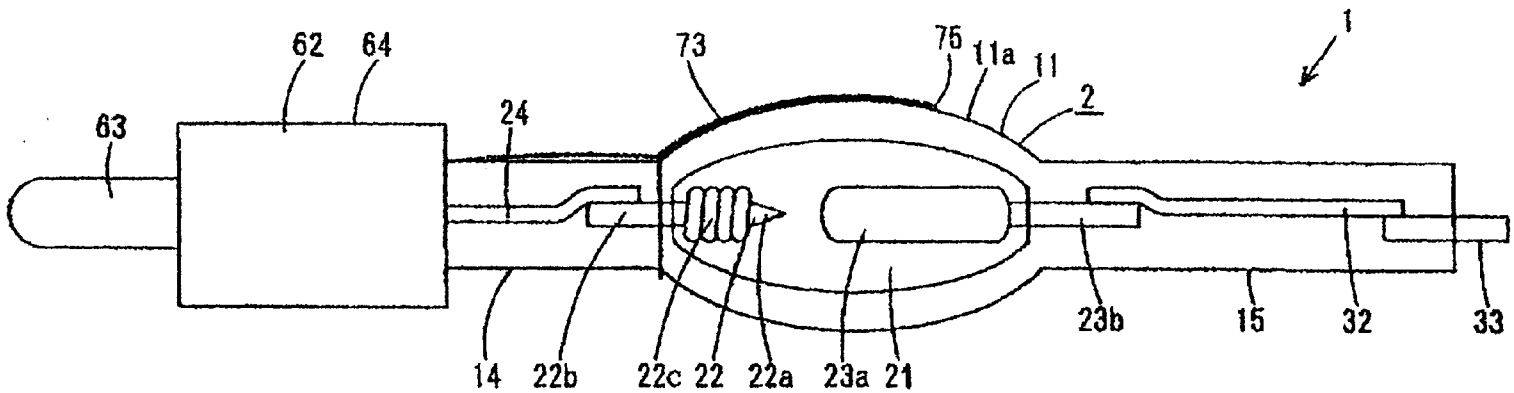
FIG. 11 is a front view of yet another embodiment of the high pressure discharge lamp of the present invention.

FIG. 10 is a front view of a sixth embodiment of the high pressure discharge lamp of the present invention, and FIG. 11 is a front view of a seventh embodiment of the high pressure discharge lamp of the present invention. With regard to either embodiment shown in FIG. 10 or FIG. 11, the elements corresponding to those in FIG. 8 or FIG. 9 are identified with the same reference numerals, explanation of which is omitted herein.

The sixth embodiment shown in FIG. 10 is different from the embodiment shown in FIG. 8 in that the end 75 of the starting conductor 73 is so located as to face the cathode 22.

The seventh embodiment shown in FIG. 11 is different from the embodiment shown in FIG. 8 in that the end 75 of the starting conductor 73 is so located as to face the anode 23.

Figure 12:
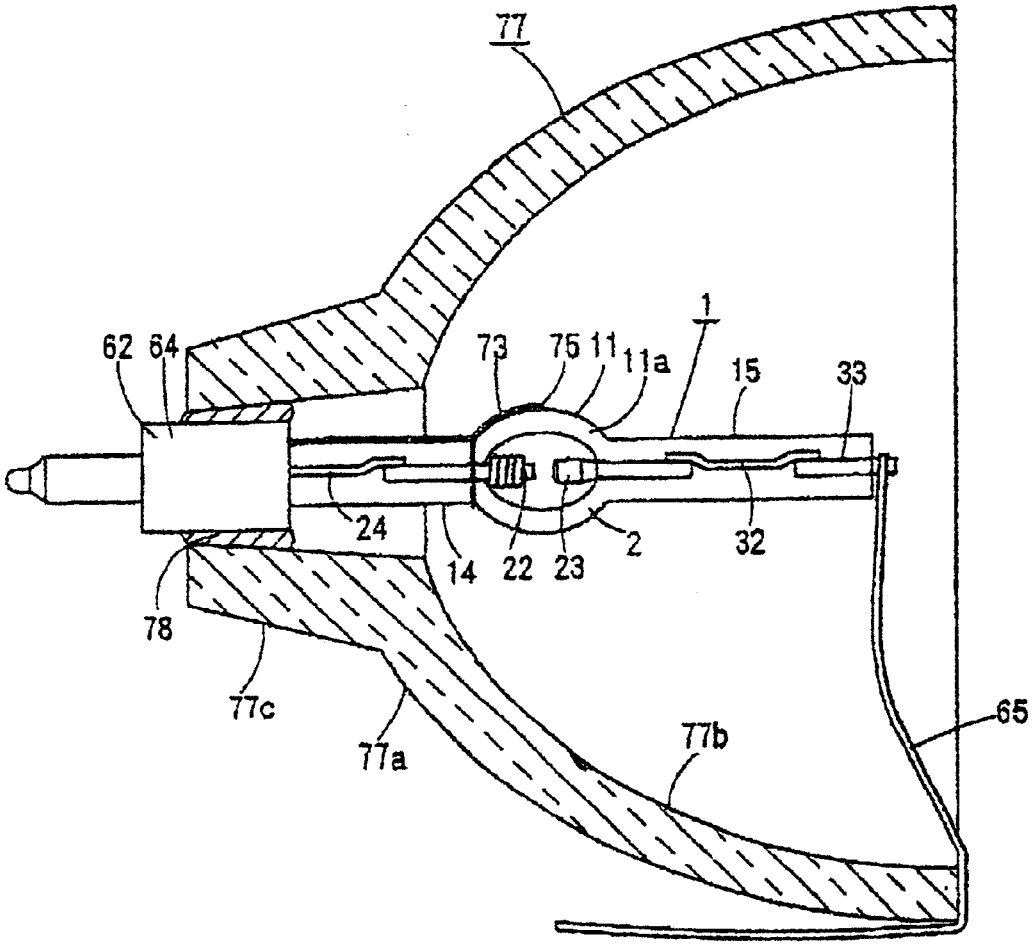
FIG. 12 is a partially-cutaway front view of another embodiment of the high pressure discharge lamp device of the present invention.

FIG. 12 is a partially-sectional front view of a second embodiment of the high pressure discharge lamp device of the present invention. The elements of the embodiment shown in FIG. 12 corresponding to those in FIG. 8 or FIG. 9 are identified with the same reference numerals, explanation of which is omitted herein.

Referring to FIG. 12, numeral 1 denotes a high pressure discharge lamp, and numeral 77 denotes a reflecting mirror.

The structure of the high pressure discharge lamp 1 is basically same as that shown in FIG. 8 except that the discharge space 21 of the discharge casing 11 has an ellipsoidal shape.

The reflecting mirror 77 is a concave mirror and consists of a glass body 77*a* having a concave inner surfaces a visible-light-reflecting/thermal-ray-transmission film 77*b* and a cylindrical portion 77*c*.

The concave portion of the inner surface of the glass body 77*a* is formed into a curve that is basically paraboloid of revolution. The cylindrical portion 77*c* is formed as an integral body with the glass body 77*a* and projects from the outer surface of the curved top of the glass body 77*a*. The visible-light-reflecting/thermal-ray-transmission film 77*b* is made of a dichroic reflection film.

The high pressure discharge lamp 1 is attached to the reflecting mirror 77 by inserting the base 64 into the cylindrical portion 77*c*, and fixing the base 64 and the cylindrical portion 77*c* with base cement 78 therebetween in a position such that the center of the rays of light emitted by the high pressure discharge lamp 1 corresponds to the focus of the reflecting mirror 77.

A wire portion 65 is welded or otherwise connected to the anode 23-side lead wire 33 of the high pressure discharge lamp 1 and drawn out of the open end of the reflecting mirror 77.

By connecting a DC output terminal of a lighting device (not shown) to a point between the wire portion 65 and the tube pin 63 of the base 64, the high pressure discharge lamp 1 is turned on. The light generated by the high pressure discharge lamp 1 strikes the visible-light-reflecting/thermal-ray-transmission film 77*b*, by which the visible light is reflected and projected in parallel to the optical axis. Meanwhile, thermal rays pass through the visible-light-reflecting/thermal-ray-transmission film 77*b* and then through the glass body 77*a*, and is radiated from the back of the reflecting mirror 77.

Figure 13:
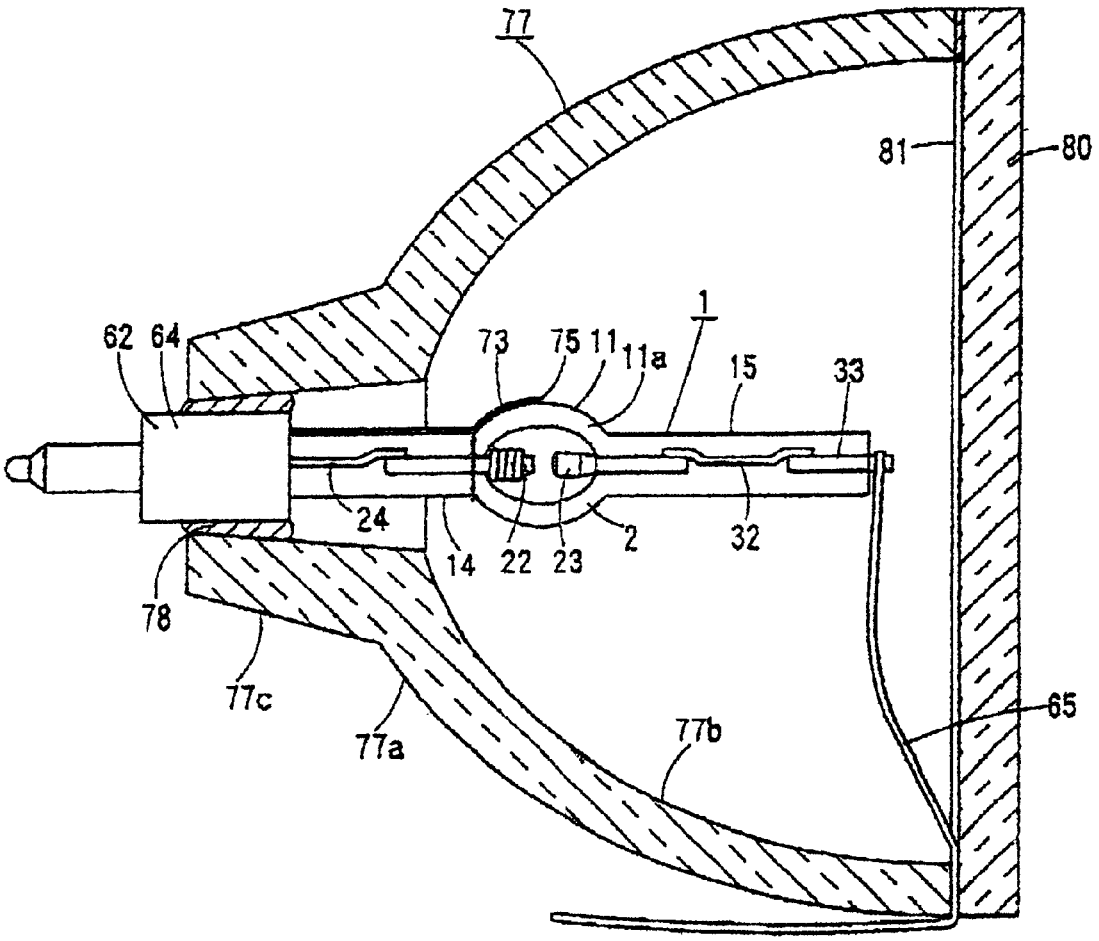
FIG. 13 is a partially-cutaway front view of another embodiment of the high pressure discharge lamp device of the present invention.

FIG. 13 is a partially-sectional front view of a third embodiment of the high pressure discharge lamp device of the present invention. The elements of the embodiment shown in FIG. 12 corresponding to those shown in FIG. 12 are identified with the same reference numerals, explanation of which is omitted herein.

The third embodiment is different from the second embodiment shown in FIG. 12 in that a translucent front cover 80 is disposed at the open end of the reflecting mirror 77.

The translucent front cover 80, which may also be called the translucent front panel, is made of glass and bonded to the open end of the reflecting mirror 77 with a silicone adhesive 81. The wire portion 65 located at the side where the anode 23 is disposed is drawn out of the device from between the open end of the reflecting mirror 77 and the translucent front cover 80.

Figure 14:
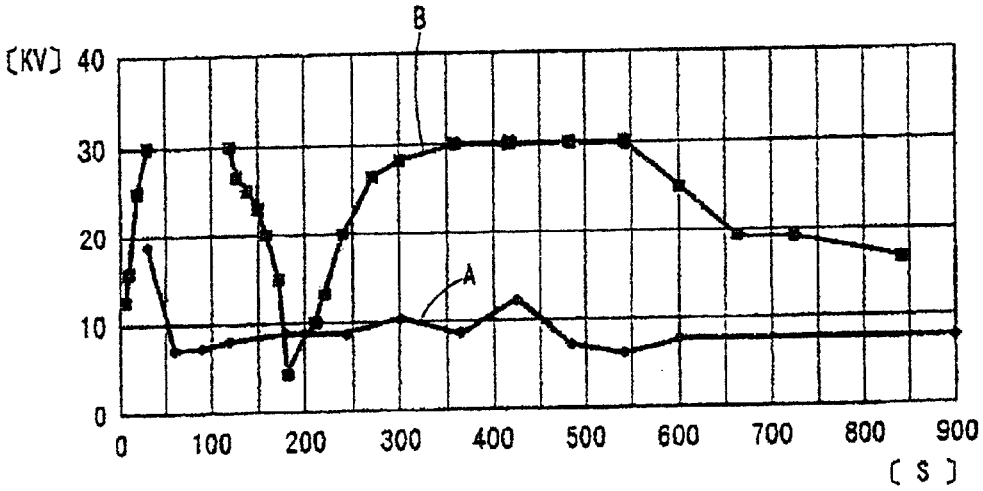
FIG. 14 is a graph showing restart characteristics of said high pressure discharge lamp device and those of a comparison example.

FIG. 14 is a graph showing restart characteristics of the third embodiment of the high pressure discharge lamp device of the present invention and showing restart characteristics of a comparison example.

Referring to FIG. 14, the horizontal axis represents the time (seconds) taken to restart the lamp, while the vertical axis represents the restart voltage (kV).

Figure 21:
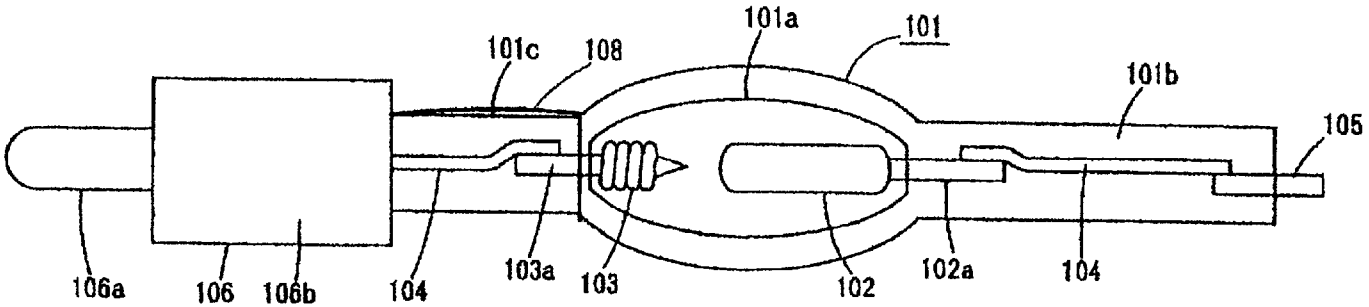
FIG. 21 is a front view of the third example of conventional high-pressure discharge lamps.

The high pressure discharge lamp device of the comparison example has the same structure and specifications to those of the present embodiment except that the starting conductor 108 of its high pressure discharge lamp has the same structure as that of the third example of the conventional art shown in FIG. 21.

The curve A and the curve B respectively represent the restart characteristics of the present embodiment and the restart characteristics of the comparison example.

As it is evident from the graph shown in FIG. 14, the restart voltage required of the present embodiment was less than half of that of the third example of the conventional art, with even the highest voltage of the present embodiment amounting to less than 20 kV.

In the graph, a portion of the curve B representing the comparison example is omitted. The gap represents the period during which the restart voltage was more than 30 kV and could not be measured, because the maximum output power of the starting power supply was limited to 30 kV.

Figure 15:
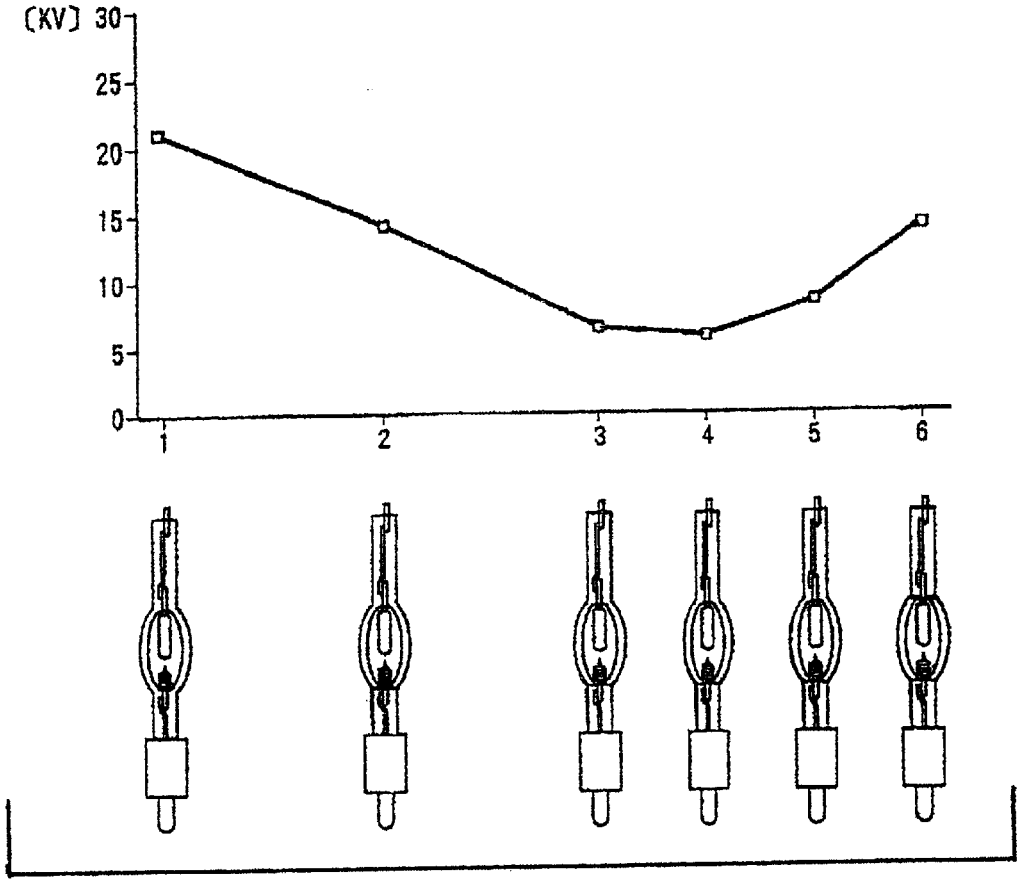
FIG. 15 is a graph showing the start-up voltages of the respective embodiments of the high pressure discharge lamp of the present invention and the start-up voltages of conventional high pressure discharge lamps.

FIG. 15 is a graph showing start-up voltages of the respective embodiments of the high pressure discharge lamp of the present invention and the start-up voltage of conventional high pressure discharge lamps, wherein the points representing the respective voltages are connected to one another so that they are represented as a single line graph.

Figure 19:
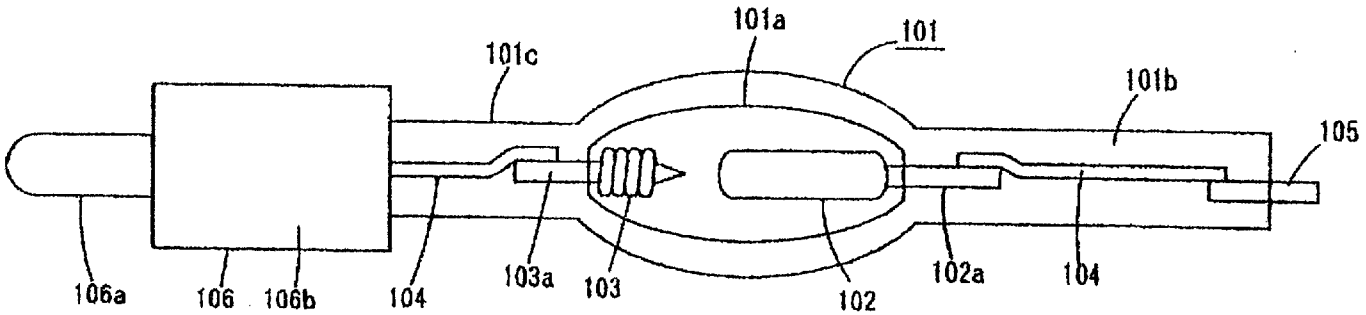
FIG. 19 is the front view of a first example of conventional high-pressure discharge lamps for liquid crystal projectors.
Figure 20:
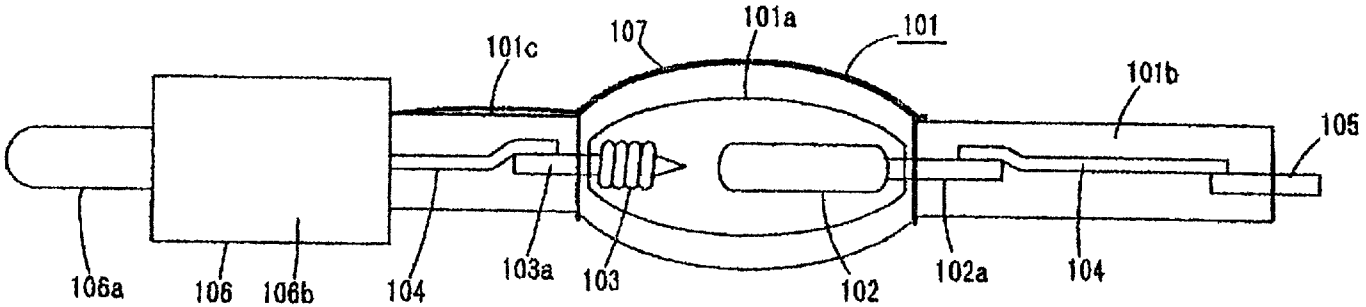
FIG. 20 is a front view of the second example of conventional high-pressure discharge lamps.

Referring to FIG. 15, the horizontal axis represents the embodiments of the present invention and the examples of the conventional art, while the vertical axis represents the restart voltage (kV). To be more specific, numeral 1 on the horizontal axis represents the first example of the conventional art shown in FIG. 19, numeral 2 the third example of the conventional art shown in FIG. 21, numeral 3 the sixth embodiment of the present invention shown in FIG. 10, numeral 4 the fifth embodiment of the present invention shown in FIG. 8, numeral 5 the seventh embodiment of the present invention shown in FIG. 11, and numeral 6 the second example of the conventional art shown in FIG. 20. The vertical axis represents the restart voltages, each of which was measured by incorporating each respective high pressure discharge lamp in a high pressure discharge lamp device having a structure as shown in FIG. 13 and measuring the restart voltage when the lamp was lit again 240 seconds after it had been turned off.

The measurement of restart voltages was conducted with each high pressure discharge lamp fixed in a reflecting mirror 77 having a translucent front cover 80 as shown in FIG. 13.

As it is evident from the graph shown in FIG. 15, restart voltage of each embodiment of the present invention was substantially lower than that of any one of the examples of the conventional art.

The present invention thus proved to be capable of reducing the start-up voltage required to start a high pressure discharge lamp containing mercury as a discharge medium or a high pressure discharge lamp device or a luminaire using such a high pressure discharge lamp.

Figure 16:
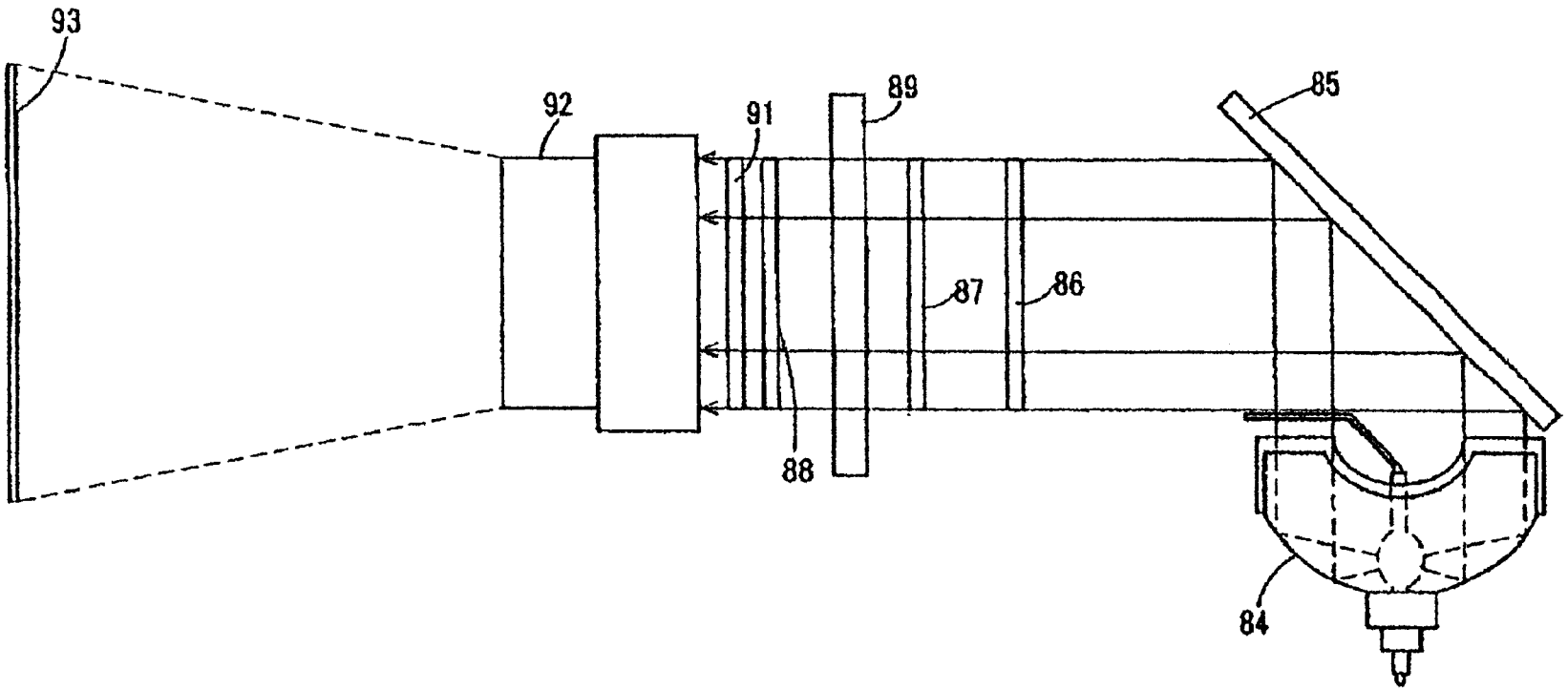
FIG. 16 is a schematic illustration to explain the concept of the optical system of a liquid crystal projector as another embodiment of the light source device of the present invention.

FIG. 16 is a schematic illustration to explain the concept of the optical system of a liquid crystal projector that is the second embodiment of the light source device of the present invention.

Referring to FIG. 16, numeral 84 denotes a high pressure discharge lamp device, numeral 85 a reflecting mirror for changing the optical path, numeral 86 a UV-IR filter, numerals 87,88 polarizing plates, numeral 89 a liquid crystal display, numeral 91 a Fresnel lens, numeral 92 a projecting lens, and numeral 93 a screen.

The high pressure discharge lamp device 84 has a structure similar to that of the high pressure discharge lamp device shown in FIG. 12.

Figure 17:
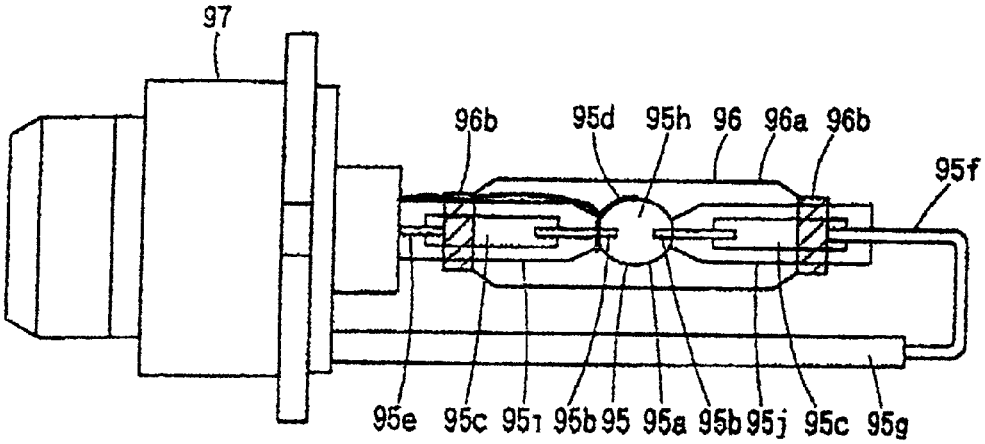
FIG. 17 is a front view of a high pressure discharge lamp for a vehicle headlight showing yet another embodiment of the high pressure discharge lamp of the present invention.

FIG. 17 is a front view of a high pressure discharge lamp for a vehicle headlight showing the eighth embodiment of the high pressure discharge lamp of the present invention.

Referring to FIG. 17, numeral 95 denotes an arc tube, numeral 96 an outer tube, and numeral 97 a base.

The arc tube 95 is provided with a discharge casing 95*a*, a pair of electrodes 95*b*,95*b*, sealed metal foils 95*c*,95*c*, a starting conductor 95*d*, lead wires 95*e*,95*f*, and an insulated tube 95*g*. The discharge casing 95*a* includes a spherical discharge space 95*h* and a pair of sealed portions 95*i*,95*j*.

The two electrodes 95*b*,95*b* have the same structure and are adapted to function to light the lamp by means of alternate current. Each sealed metal foil 95*c* is connected at one of its ends to the electrode 95*b* and at the other end to the corresponding lead wire 95*e* or 95*f*, and, in this state, airtightly embedded in the corresponding sealed portion 95*i* or 95*j*.

The starting conductor 95*d* has a structure similar to that of the starting conductor 73 shown in FIG. 11.

The lead wire 95*e* drawn out in the direction of the base 97 is directly introduced into the base 97.

The lead wire 95*f* drawn out in the opposite direction of the base 97 is folded back and encased in the insulated tube 95*g*, and, in this state, introduced into the base 97.

The outer tube 96 comprises a cylindrical portion 96*a* at the center and narrow portions 96*b*,96*b* sandwiching the cylindrical portion 96*a*. The cylindrical portion 96*a* primarily encloses the discharge space 95*h*. The narrow portions 96*b*,96*b* are respectively bonded to the sealed portions 95*i*,95*j* by means of a silicone adhesive.

The base 97 is so designed as to be attached to a headlight of a vehicle (not shown) in such a state that the discharge casing 95*a* is supported by one of the sealed portion, i. e. the sealed portion 95*i*, and that the lead wires 95*e*,95*f* are connected to base terminals (not shown).

Figure 18:
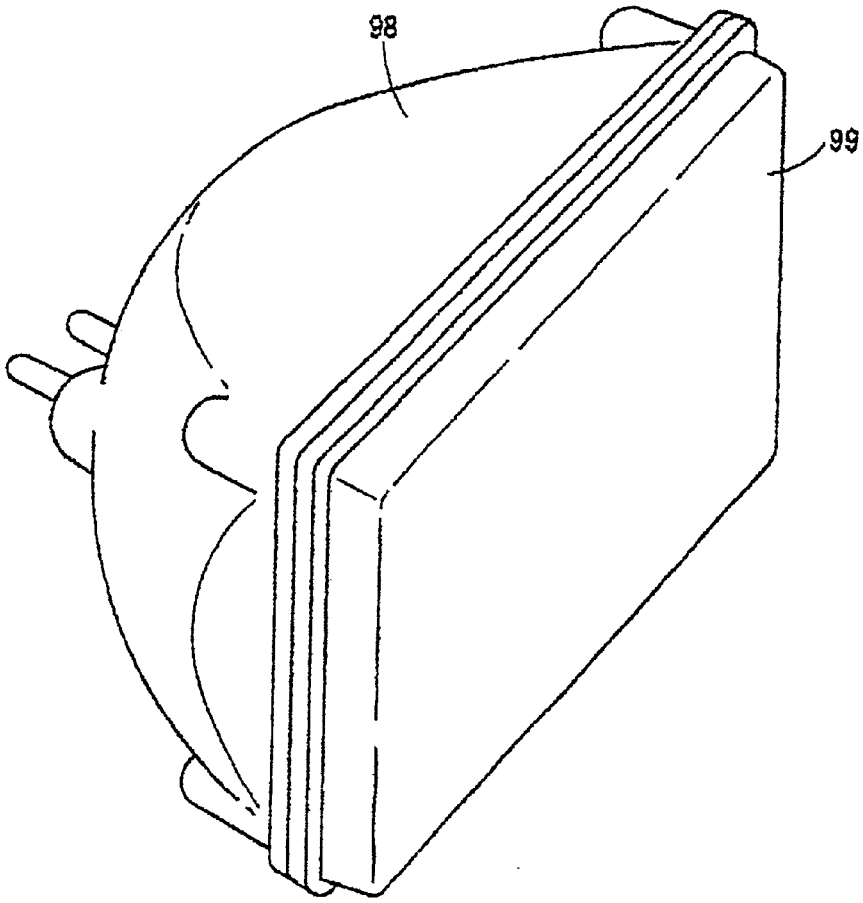
FIG. 18 is a perspective of a vehicle headlight showing yet another embodiment of the light source device of the present invention.

FIG. 18 is a perspective of a vehicle headlight as the third embodiment of the light source device of the present invention.

Referring to FIG. 18, numerals 98 and 99 respectively denote a reflecting mirror and a front lens. The reflecting mirror 98 is so designed as to permit a high pressure discharge lamp shown in FIG. 17 to be removably attached to the reflecting mirror 98 from the back of the mirror.

POSSIBLE INDUSTRIAL APPLICATION

As described above, a high pressure discharge lamp and a high pressure discharge lamp device according to the present invention can widely be applicable to a light source device. In the wide range of their usage, they are particularly suitable for image projecting apparatuses, such as liquid crystal projectors and overhead projectors, floodlight apparatuses, signal light apparatuses.

What is claimed is:

1. A high pressure discharge lamp comprising:

a discharge casing having an airtight discharge space;

a pair of electrodes disposed in the discharge space with one end of an electrode facing an end of the other electrode;

a pair of first sealed portions respectively sealing the other ends of the electrodes in an airtight state;

a lead portion provided at either one of the ends or each end of the discharge casing in such a manner that one end of each lead portion is connected to said other end of the electrode disposed at the same side of the discharge casing and airtightly sealed in the corresponding first sealed portion;

a second sealed portion for airtightly sealing the other end of said one lead portion;

each said sealed portion including an air tight space, a separate metal conductor, and a lead wire electrically connected thereto;

a middle chamber which is provided between each second sealed portion and the first sealed portion located in an airtight state so that the corresponding lead portion passes through the middle chamber;

wherein one of the two electrodes serves as a cathode while the other electrode serves as an anode, and the high pressure discharge lamp is so designed as to be lit in a position with the anode located above the cathode;

the discharge casing is provided with a convex portion constituting a discharge space; and the dimensions of various components of the lamp are set such that:

$$0.29<\{(a-n)/L\}<2.7$$

$$5L<D$$

when the distance between the upper end and the lower end of the convex portion is represented by 2*a;* a reference axis of 2*a* defined as an axis along the discharging path between the pair of opposing electrodes the distance from the lower outer end of the convex portion to the midpoint of the distance between the two electrodes is represented by n;

the distance between the anode and the cathode is represented by L; and the diameter of the discharge space formed in the convex portion is represented D.

2. A high pressure discharge lamp as claimed in claim 1, wherein each lead portion has lead wires and conductors that are welded to one another at the corresponding first sealed portion and the second sealed portion.

3. A high pressure discharge lamp as claimed in claim 1 or claim 2, wherein each middle chamber is maintained in a vacuum.

4. A high pressure discharge lamp as claimed in claim 1 or claim 2, wherein each middle chamber is filled with a rare gas.

5. A high pressure discharge lamp as claimed in claim 1, wherein the lamp is provided with only a single middle chamber, which is disposed adjacent to one of the first sealed portions, and wherein the high pressure lamp is lit in such a position that the middle chamber is located above the other first sealed portion.

6. A high pressure discharge lamp as claimed in claim 1, wherein each lead portion extending through said middle chamber is providing with a filament that is so designed to fuse at the end of a predetermined life span.

7. A high pressure discharge lamp as claimed in claim 6, wherein the filament includes a filament material extending in a straight line.

8. A high pressure discharge lamp as claimed in claim 6, wherein the filament includes a coiled filament.

9. A high pressure discharge lamp comprising;

a translucent discharge casing;

a pair of electrodes sealed in the discharge casing;

a discharge medium which is sealed in the discharge casing;

said medium containing at least one of mercury and a rare gas;

a starting conductor for receiving the same electrical potential as that of the electrode onto which mercury will condense after the lamp is turned off;

said starting conductor extending from the vicinity of said electrode and further extending along an outside of said discharge casing, with the leading end of said starting conductor positioned between a first location at the side of said electrode and a second location where at the side of the other electrode; and said leading end of said starting conductor positioned opposing to said other electrode having a different electrical potential from that of said starting electrode.

10. A high pressure discharge lamp as claimed in claim 9, wherein the leading end of the starting conductor is aligned with a point between the pair of electrodes.

11. A high pressure discharge lamp as claimed in claim 9 or claim 10, wherein:

the electrodes consist of a cathode and an anode; and the starting conductor receives the same electrical potential as that of the cathode.

12. A high pressure discharge lamp device comprising:

a high pressure discharge lamp as claimed in claim 9; and a reflecting mirror positioned concentric with an optical axis of the high pressure discharge lamp.

13. A high pressure discharge lamp device comprising:

a high pressure discharge lamp as claimed in claim 9; and a reflecting mirror;

said reflecting mirror having a concave shape;

said reflecting mirror being integrally secured with the high pressure discharge lamp in such a manner as to cover at least a light emitting portion of the high pressure discharge lam.

14. A high pressure discharge lamp device comprising:

a high pressure discharge lamp as claimed in claim 9;

a reflecting mirror;

said reflecting mirror having a concave shape;

said reflecting mirror being integrally secured with the high pressure discharge lamp in such a manner as to cover the high pressure discharge lamp; and a translucent front cover that closes the open end of the reflecting mirror.

15. A light source device comprising:

a high pressure discharge lamp as claimed in claim 9 further including a main body to which the high pressure discharge lamp is attached.

16. A high pressure discharge lamp device comprising:

a high pressure discharge lamp as claimed in claim 1; and a reflecting mirror positioned concentric with an optical axis of the high pressure discharge lamp.

17. A high pressure discharge lamp device comprising:

a high pressure discharge lamp as claimed in claim 1; and a reflecting mirror;

said reflecting mirror having a concave shape;

said reflecting mirror being integrally secured with the high pressure discharge lamp in such a manner as to cover at least a light emitting portion of the high pressure discharge lamp.

18. A high pressure discharge lamp device comprising:

a high pressure discharge lamp as claimed in claim 1;

a reflecting mirror;

said mirror having a concave shape;

said mirror being integrally secured with the high pressure discharge lamp in such a manner as to cover the high pressure discharge lamp; and a translucent front cover that closes the open end of the reflecting mirror.

19. A light source device comprising:

a high pressure discharge lamp as claimed in claim 1 further including a main body to which the high pressure discharge lamp is attached.

* * * * *